US007820898B2

(12) United States Patent
Bayliss

(10) Patent No.: US 7,820,898 B2
(45) Date of Patent: Oct. 26, 2010

(54) THUNDERLINE BOLT ON TREMLO SYSTEM

(75) Inventor: Stephen Edward Bayliss, Hereford (GB)

(73) Assignee: S E Bayless, Herefordshire (GB)

( * ) Notice: Subject to any disclaimer, the term of this patent is extended or adjusted under 35 U.S.C. 154(b) by 86 days.

(21) Appl. No.: 11/108,577

(22) Filed: Apr. 19, 2005

(65) Prior Publication Data

US 2006/0016318 A1 Jan. 26, 2006

(30) Foreign Application Priority Data

Jul. 20, 2004 (GB) ..... 0416178.2

(51) Int. Cl.
*G10D 3/00* (2006.01)

(52) U.S. Cl. ..... 84/313

(58) Field of Classification Search ..... 84/312 R, 84/313

See application file for complete search history.

(56) References Cited

U.S. PATENT DOCUMENTS

| | | | | |
|---|---|---|---|---|
| 4,928,564 | A * | 5/1990 | Borisoff et al. | 84/313 |
| 6,034,311 | A * | 3/2000 | Fisher, IV | 84/313 |
| 2001/0002570 | A1 * | 6/2001 | McCabe | 84/312 R |
| 2004/0074373 | A1 * | 4/2004 | Goto | 84/452 R |

* cited by examiner

*Primary Examiner*—Kimberly R Lockett

(57) ABSTRACT

A bolt on tremolo unit. The tremolo arm is depressed which rotates a shaft within a frame. The rotating shaft engages a conrod against a folded steel sheet. This forces it to tip thus lowering the the pitch of the strings. When the tremolo arm is released, the expansion springs pull against a shaft spring connecting hinge and return the tremolo to its original position. When the tremolo arm is pulled across the frame causing the adjustable tail piece to clear the frame, the shaft is free to rotate in the opposite direction. This raises the pitch. When the adjustable tail piece is returned to the stop block or plate the guitar returns to standard pitch.

1 Claim, 30 Drawing Sheets

17

16

FIG 8A
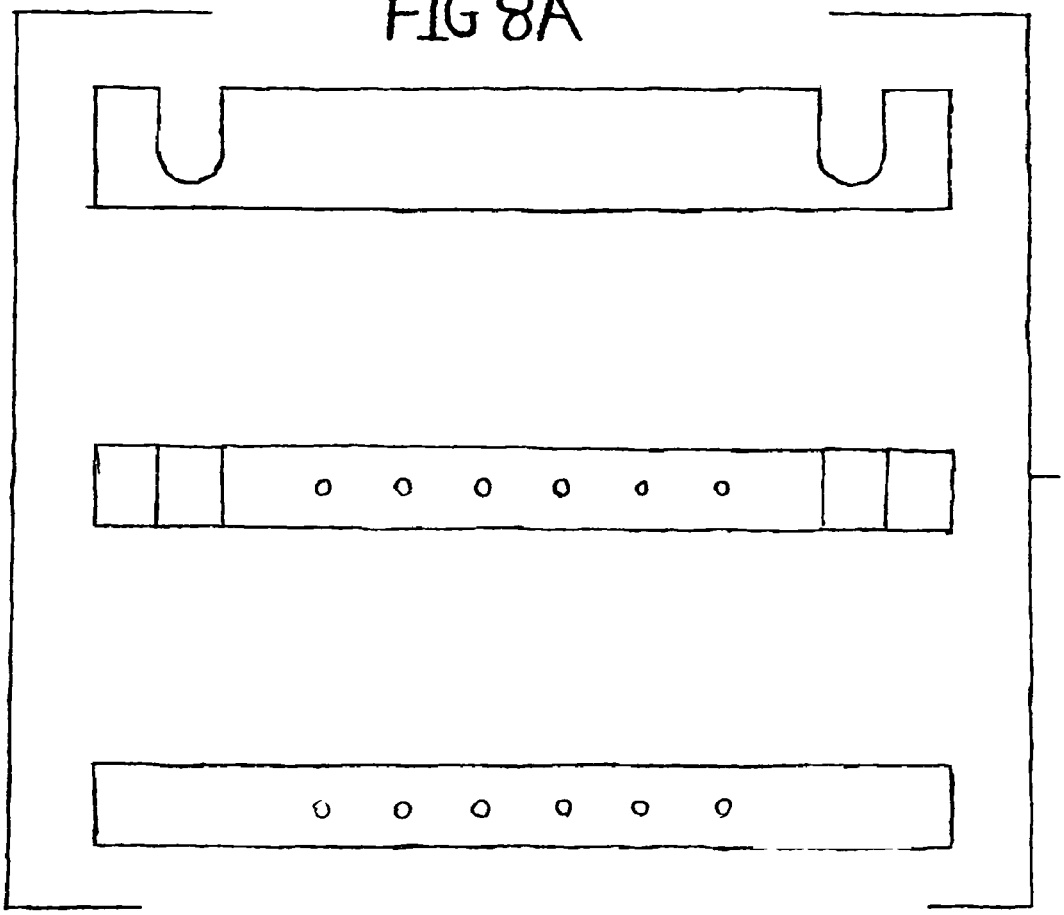
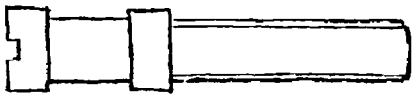
FIG 8B
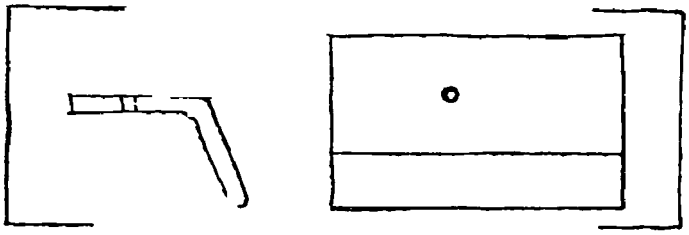
FIG8C

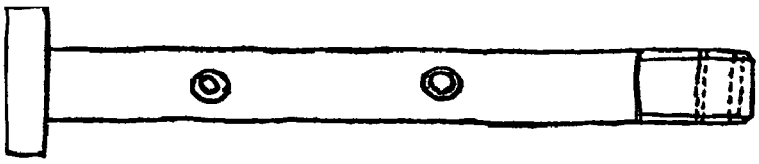
FIG 11A
FIG 11B
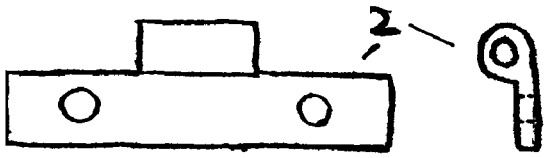
FIG 11C
FIG 11D
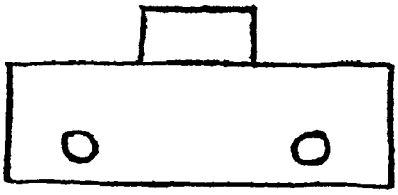
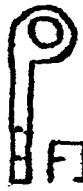
FIG 11E
FIG 11F
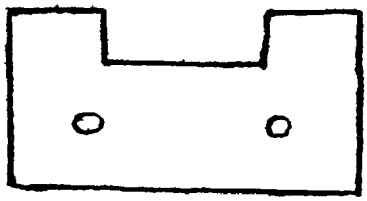
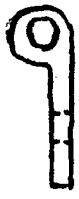
FIG 11G
FIG 11H
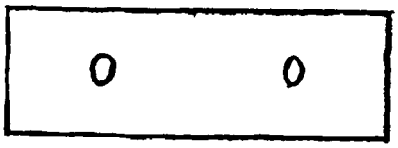
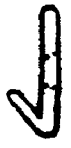
FIG 11I
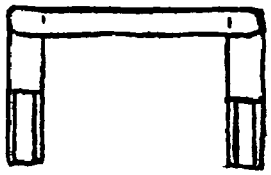
FIG 11J

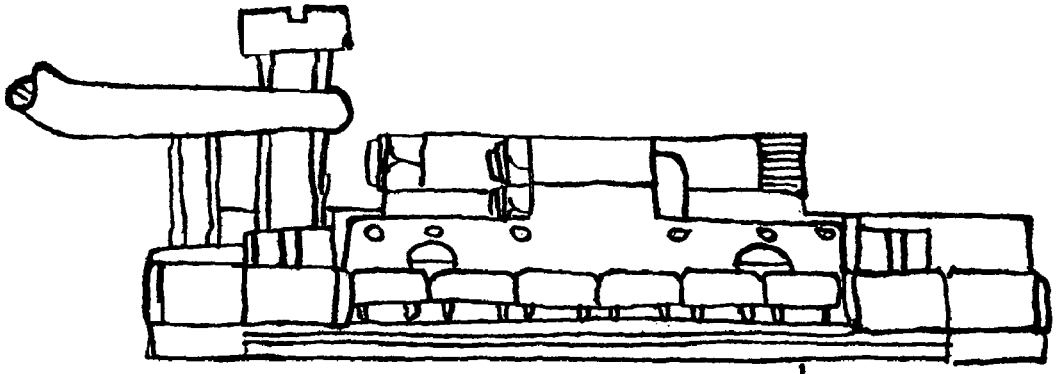
FIG 16A 18'
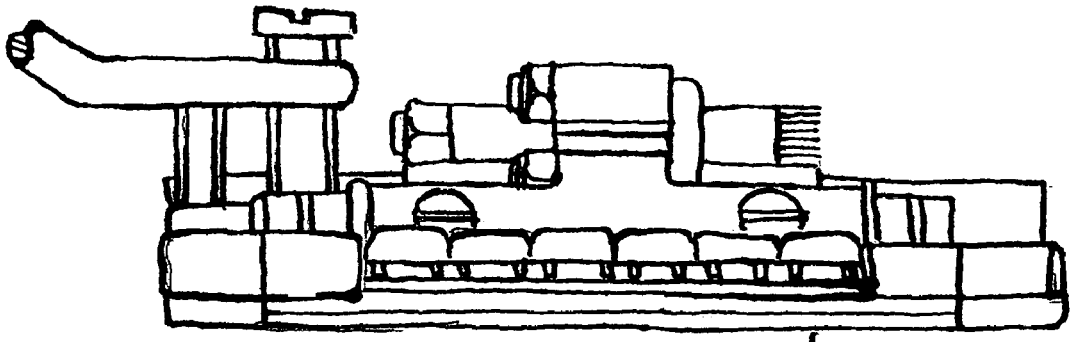
FIG 16B 18'

FIG 21A
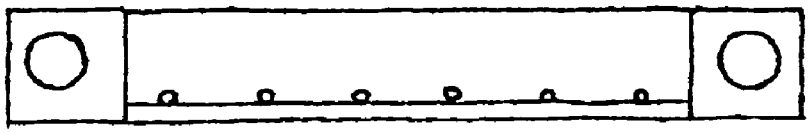
FIG 21B
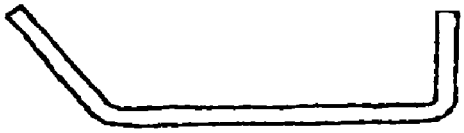
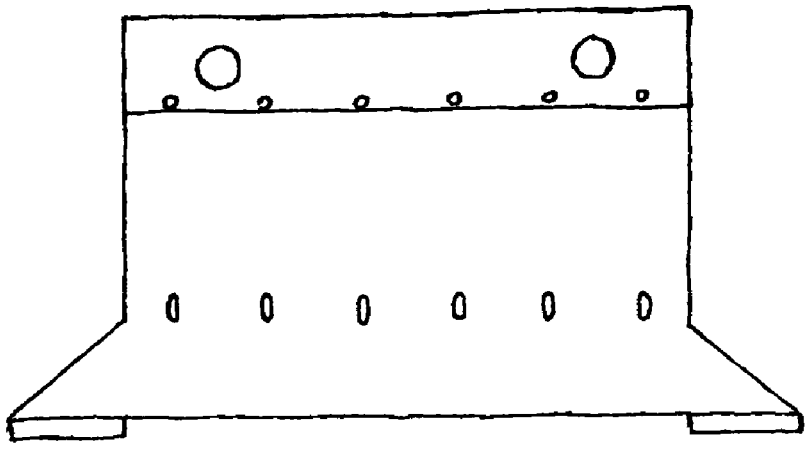
FIG 21C
FIG 21D
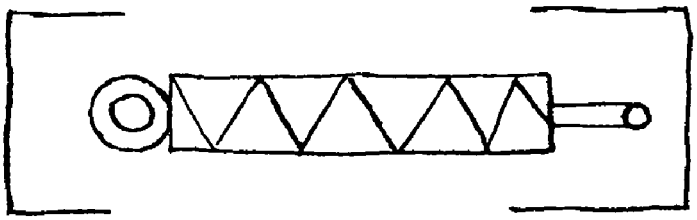

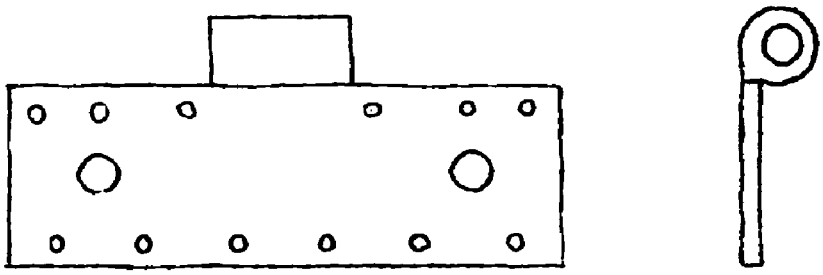
FIG22A
FIG22B
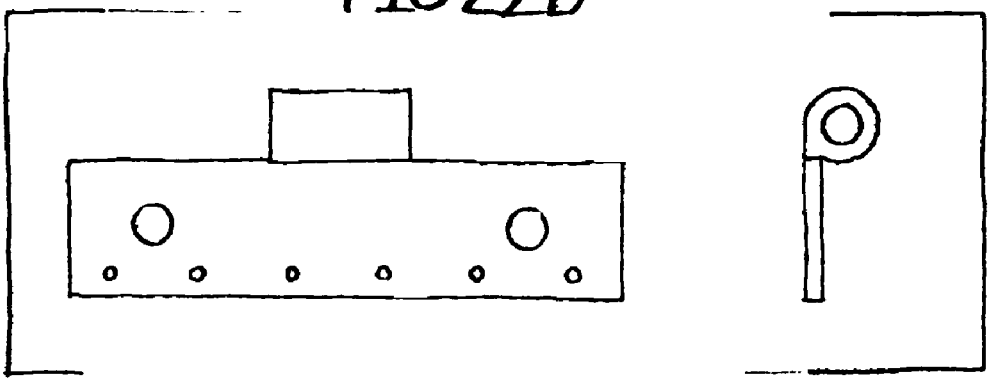
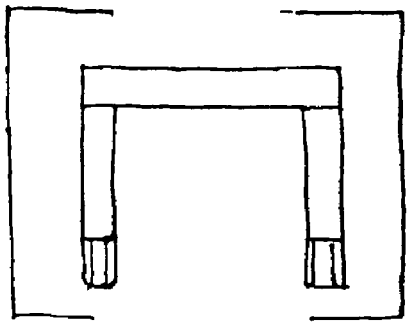
FIG22C
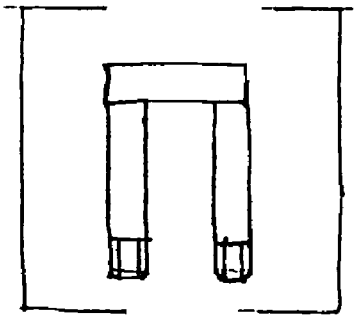
FIG22D

FIG 29A
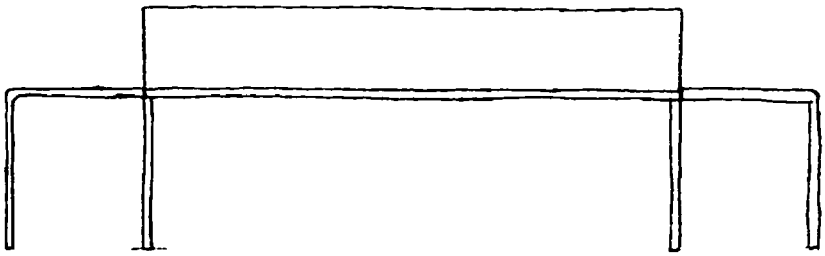
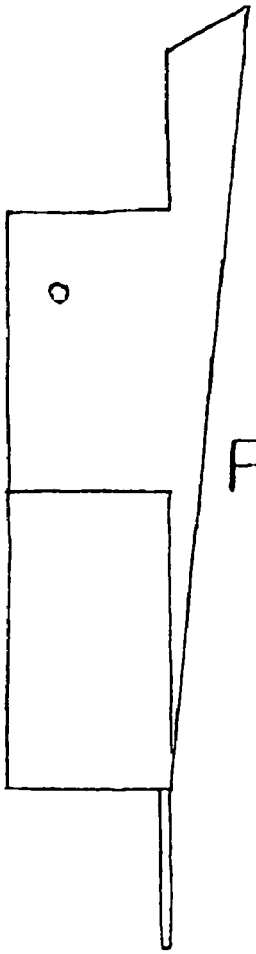
FIG 29B
FIG29C
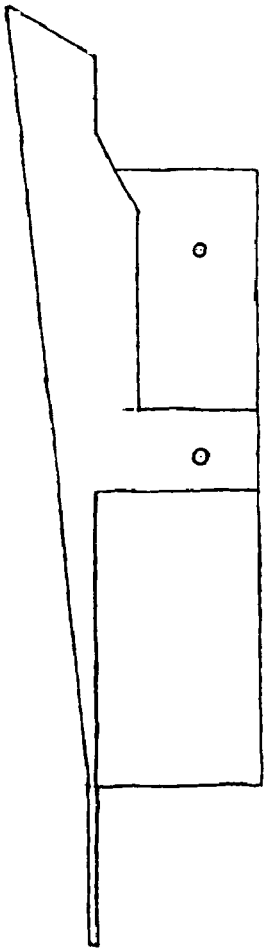

THUNDERLINE BOLT ON TREMLO SYSTEM

CROSS REFERENCE TO RELATED APPLICATIONS

A prior application has been made to the united kingdom of Great Britain patent office.

Patent Application number;

GBO416178.2

STATMENT REGARDING FEDERALLY SPOSORED RESEARCH AND DEVELOPMENT not applicable

REFERENCE TO SEQUENCE LISTING A TABLE OR A COMPUTER PROGRAM UNDER COMPACT DISK APPENDIX

Not applicable

BACKGROUND OF THE INVENTION

1. Field of the Invention

The enclosed details refer to the field of musical instruments, specifically stringed instruments and their fitted tremolo devices 2. Description of Prior Art Tremolos are often situated at the intonation end of the stringed instrument, thus a tremolo system normally hand operated, slackening and tightening instrument strings, which can be incorporated into the stringed instrument design, variations for the plate either, or be a separate unit which requires fitting with, a certain amount of work Wilkinson invention does not involve the.

A good tremlo will return to pitch after use which is usually the exact position it started from before use, yet Unfortunately there are very few low buget tremlos that will do this.

Tremolo devices are commonly found upon instruments with a 25½" scale, because the string tension is much higher, thus the strings are able to hold against counter pull of the springs, thus maintaining normal playing pitch and string tension with ease of operation, yet, however when tremolos are fitted to instruments with a 24¾" scale, the spring force must be increased to compensate for the lower string tension.

However the result in operating action of the said tremolo is very hard and heavy which results in a tremolo that is difficult and requires a lot of effort to use in practice, thus why tremolos are more common on 25½" scale stringed instruments thus when tremolos upon a short scale instrument have spring force reduced to affect an easier and more comfortable operating action, standard playing string tension suffer, thus the result is a loss of clarity and inferior sound of notes that would be eliminated if the instrument was it's standard fixed non-tremolo design, yet on a 25½" scale instrument the string tension is same either tremolo or non tremolo option, thus it is a common problem that has yet to be overcome.

Tremolos often require specialist routing out and cavities in order to be properly fitted, but tremolos can also be mounted directly on top of stringed instrument surface, wherein this requires fitting which normally involves screwing pins directly into the instrument surface, thus devaluing and damaging the instrument, to which as a result most short scale instruments tend to be of a hard tail fixed bridge non tremolo design, thus also instruments with strings that pass directly through the surface rarely have any tremolo due to its difficulty to facilitate.

A large portion of fixed non tremolo tend to be of the tune-o-matic design, thus comprising of a tail piece, on which the guitar strings slide through, to which the piece is the width of the base of the guitar neck and is suspended away from the guitar body by two threaded posts which are screwed into threaded inserts situated inside the guitar body, thus strings pass from the tail piece and over an adjustable bridge mounted in a similar configuration to the tail piece.

Friction also occurs in many tremolo's where metal rubs against metal, which thus prevents said tremolo from returning to its exact start position promoting premature wear of parts to an unsatisfactory state, thus bearings have been known to be used to reduce friction, yet bearings are expensive and prone to collapse, thus jamming said tremolo and causing problems.

To overcome these problems it would require a tremolo that can maintain hard tail tension with an easy operating action, return to pitch after each operation, along with low friction fulcrum points, thus maintaining stability whilst also being cost effective to produce.

STATEMET OF INVENTION

The presented invention is one that may be retrofitted onto any guitar of any designation maintain good playing pitch, stability and ease of operation without being expensive to produce.

BRIEF SUMMARY OF INVENTION

The presented invention is a tremolo device which; can be bolted onto the top of any tune-o-matic guitar body with a small amount of work, by replacing the tail piece and to any any through body strung, as variations.

The presented invention will return to the same position after each operation, will maintain standard fixed non tremolo tension, could be cost effective to produce, with low operational friction due to rotational pivots.

The presented invention meets all the above criteria through unconventional means of differential forces created connection of hinge points operational shaft and expansion springs that are mounted upon and within a folded suitable material frame, which is bolted directly on top of the guitar body using the two threaded inserts provided for the tail piece, thus the instrument bridge remains completely unaltered with no foreign holes made in the guitar body.

The presented invention leverage of the springs pulling against the hinge assembly connected to rotary shaft, is greater than the force created created from the pull of folded tremolo tail stop steel sheet to which strings are connected, yet the force created by tremolo operating arm is capable of over riding both of of these forces, thus wherein said operating force in the direction of shaft rotation is added to the force of either spring or string pull for which ever desired direction, thus allowing a light operating action and as said strings do not have the force to overcome said springs, aided by unconventional force transfer connection of a conrod, hard tail non tremolo instrument string tension is achieved.

The presented invention return to original position is achieved with an adjustable tail piece at the end of the operating arm, which returns upon a stop block or plate that resists the the force of said springs, thus giving the arm a definitive point to rest upon, holding tremolo to its original position under its own force which in turn aids stability and non tremolo tension, whilst retaining the ability to move above and below standard pitch through operating moving x and y axis thus allowing adjustable stop to move above or below stop point to raise or lower pitch at will.

Also presented invention can operate well from cheap materials, as frame can be folded from sheet steel, thus all parts can be assembled upon, within it, with rotational hinges which may be lubricated with petroleum jelly, suitable lubricant thus reducing friction, enabling a fluid mechanism, and ease of performance.

The presented invention can be fitted to any through strung instrument body with simple modifications to presented invention that reduce the distance between instrument body and bridge by reversing polarity of operating arm on bridge saddles, or using a roller bar carrier for the strings.

BRIEF DESCRIPTION OF THE SEVERAL VIEWS OF THE DRAWING

FIG. 8A; Shows the back, front, plan and underside views of spring adjustment bar for presented invention FIG. 8B; Shows a side view of the spring adjustment pin for presented invention.

FIG. 8C; shows a side and plan views of presented invention stop plate.

FIG. 11A; Shows a side view of presented invention torque amplify shaft

FIG. 11B; Shows the rear view of presented invention element 2 operating shaft conrod hinge.

FIG. 11C; Shows a side view of presented invention element 2 operating shaft conrod hinge.

FIG. 11D; Shows a front view of presented invention operating shaft hinge for spring.

FIG. 11E; Shows a side view of presented invention operating shaft hinge for spring.

FIG. 11F; Show a plan view of hook hinge.

FIG. 11G; Shows a side view of hook hinge.

FIG. 11H; shows a plan view of hook

FIG. 11I; shows a side view of hook

FIG. 11J; Shows a plan view of standard version conrod for presented invention.

FIG. 16A; Shows a front view of bridge saddle variant Of presented invention without cover previously omitted element 18 a bridge saddle.

FIG. 16B; Shows a front view of through instrument strung bridge saddle variant of presented invention previously omitted element 18 a bridge saddle.

FIG. 21B; Shows a side view of through instrument strung intonation saddle vertical linear plate variant.

FIG. 21C; Shows a plan view of through instrument strung intonation saddle vertical linear plate variant.

FIG. 21D; Shows a plan view of expansion spring FIG. 22A shows the front and side views bridge saddle folded tremolo tail stop steel sheet conrod pivot variant.

FIG. 22B; shows front and side views of bridge saddle variant folded tremolo tail stop steel sheet conrod pivot variants.

FIG. 22C; Shows a plan view of bridge saddle variant conrod.

FIG. 22D; Shows a plan view of through bridge saddle variant.

FIG. 29A; Shows a rear view for the cover of presented invention

FIG. 29B; Shows side view of non operating side of cover for presented invention FIG. 29C; Shows side view of operating side of cover for presented invention FIG. 30A; Shows standard version of presented invention in non operational position with instrument string attached over tune o matic bridge, previously omitted element 9 a bridge, with previously omitted element 17 a instrument string.

DETAILED DESCRIPTION OF INVENTION

Figures 12A, 12B, 12C:
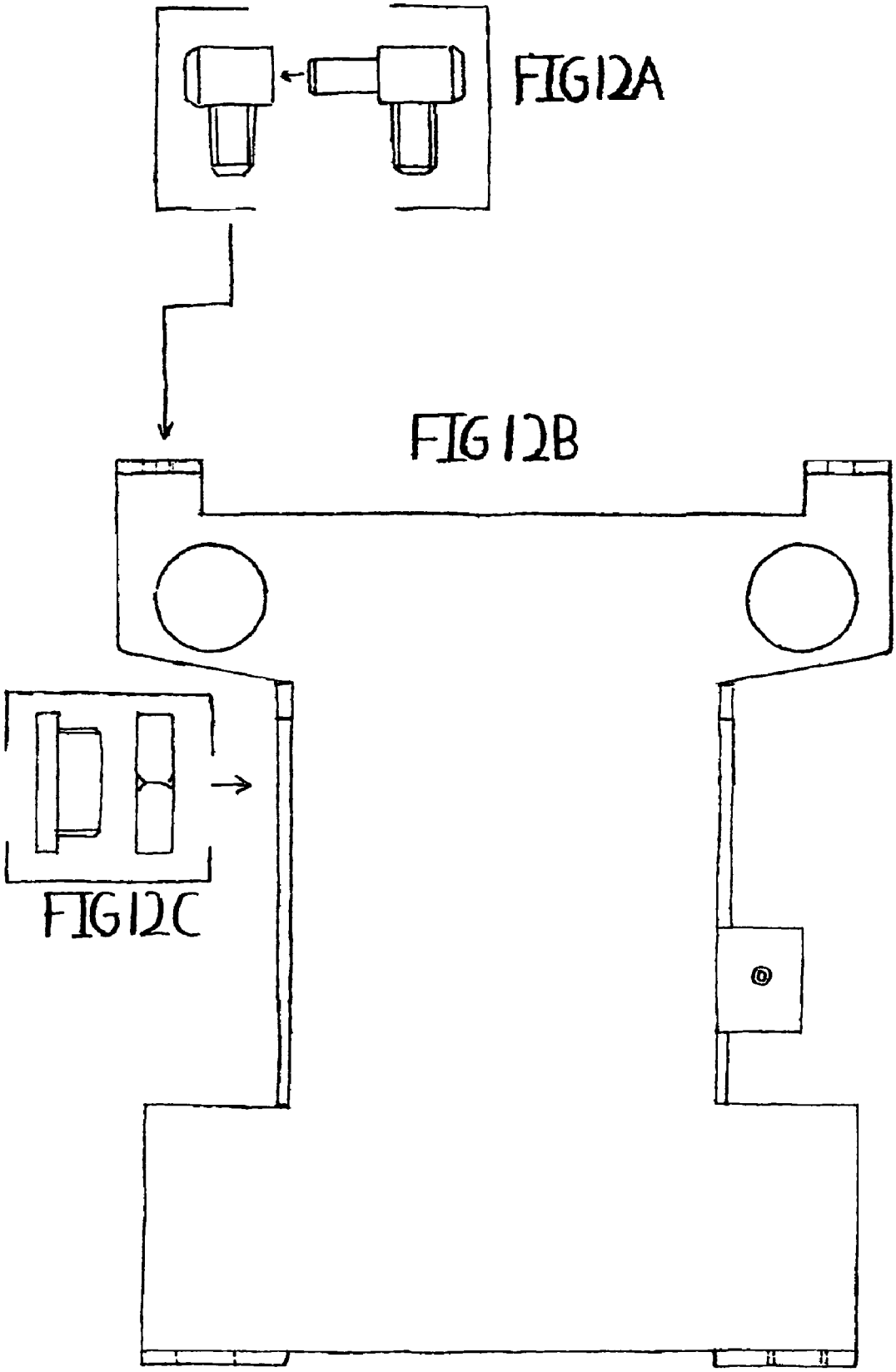
FIG. 12A; shows a plan view of both halves of presented invention folded tremolo tail stop steel sheet pivot pieces.
FIG. 12B; Shows a plan view of standard version of presented invention frame FIG. 12C; Shows a plan view of both bearing bush inserts for presented invention.
Figure 20:
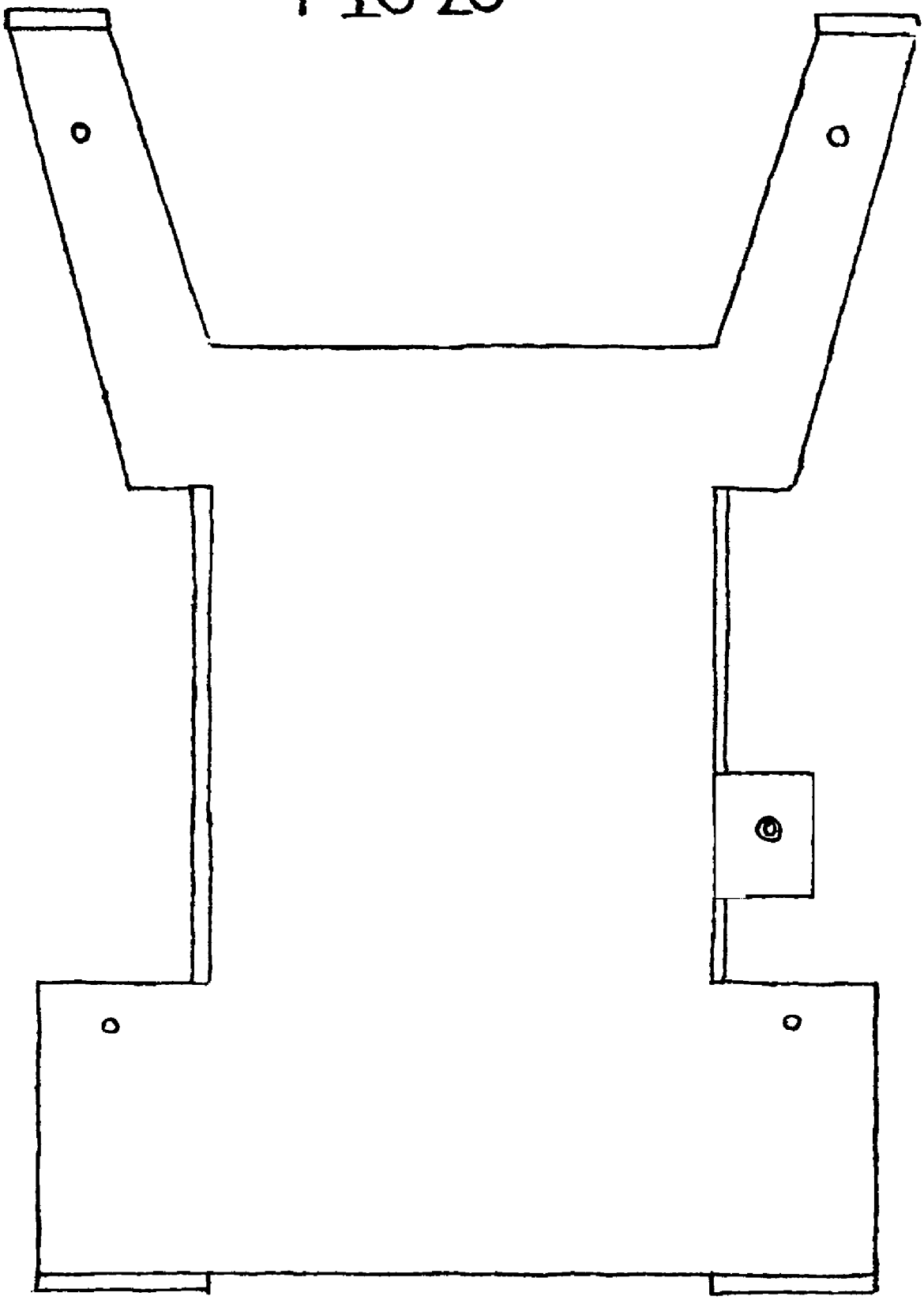
FIG. 20; Shows a plan view of through instrument strung frame of presented invention FIG. 21A; Shows a front view of through instrument strung intonation saddle vertical linear plate variant.
Figure 27A:
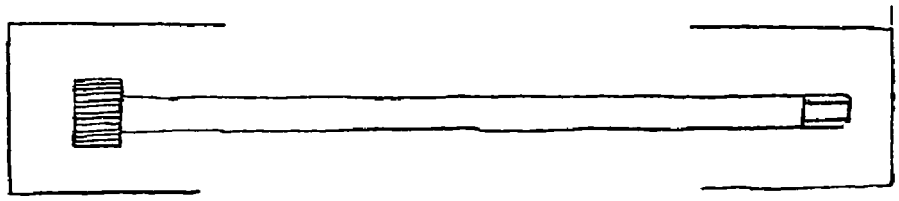
FIG. 27A; Shows a side view of through instrument strung tune-o-matic variant roller bar.
Figure 27B:
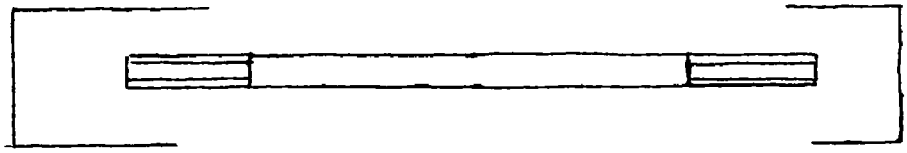
FIG. 27B; Shows a side view of through instrument strung tune-o-matic variant tie bar.
Figure 27C:
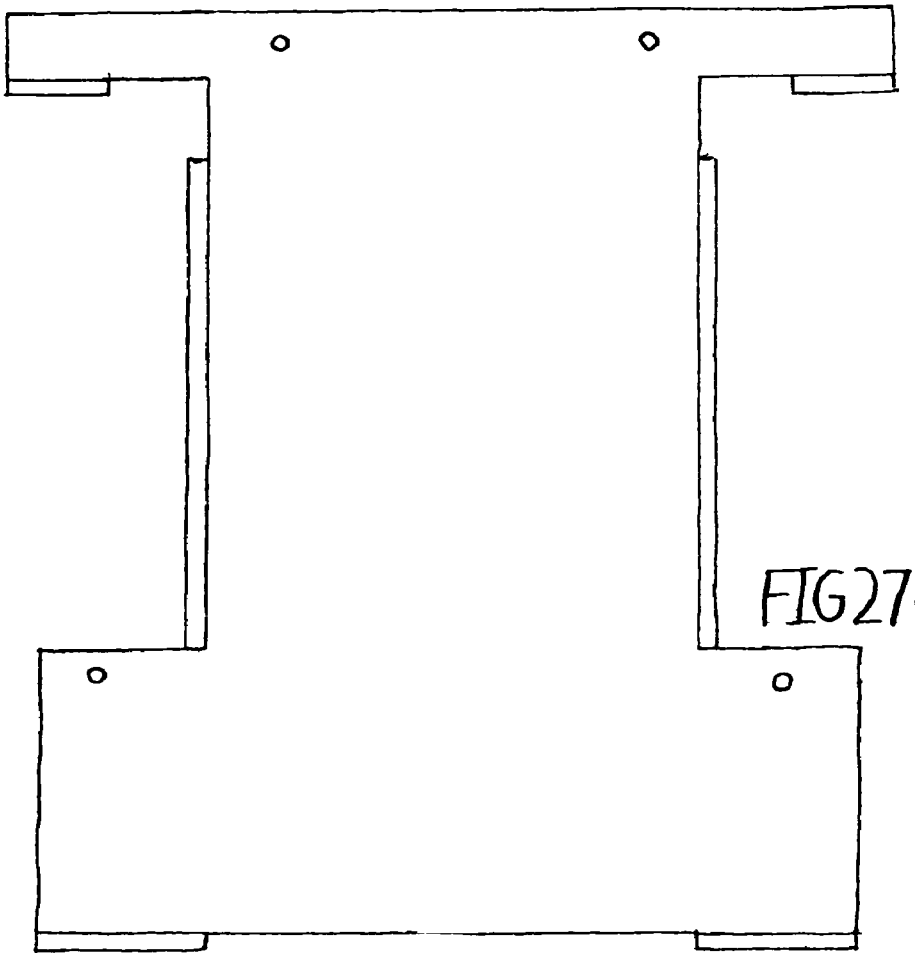
FIG. 27C; Shows a plan view of through instrument strung tune-o-matic variant frame.
Figure 28A:
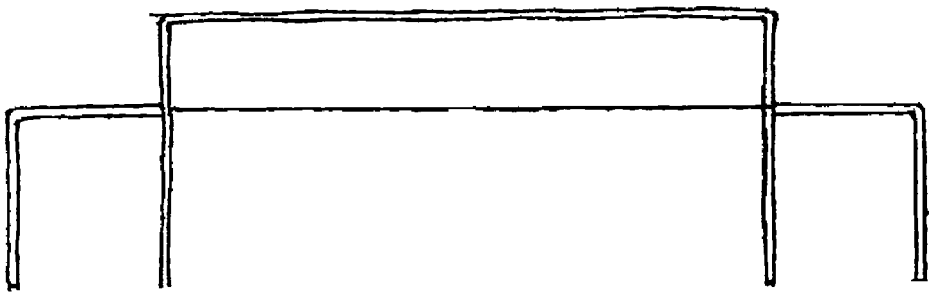
FIG. 28A; Shows a front view for cover of presented invention
Figure 28B:
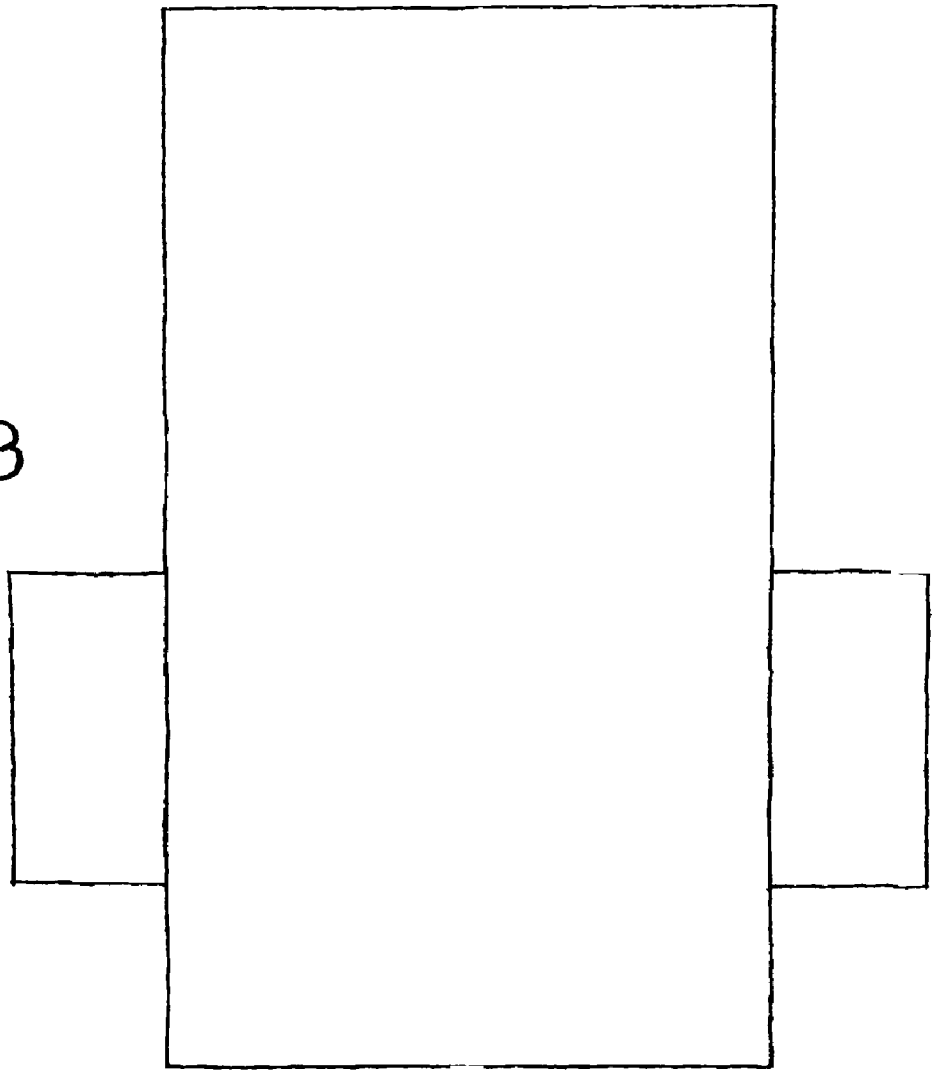
FIG. 28B; Shows a plan view for cover of presented invention

The frame for presented invention is made from steel, suitable metal sheet a munimum of 2 mm thick marked out as per FIG. 12B, FIG. 20, FIG. 27C (note if constructing by hand tools allow 2 mm in between side fold line and base) thus all holes are drilled and tapped out as per FIG. 12B, FIG. 20, FIG. 27C, thus all excess material is removed from around template and deburred, thus allowing all sides around template to be folded 90 degrees vertical from base section of presented invention frame FIG. 12B, FIG. 20, FIG. 27C, which may be done by hand or mechanical press and suitable constructed jig.

A pair of threaded insert bearing bushes (FIG. 12C) are made from brass, phosphor bronze or similar material rod, turned upon a suitable lathe with an intended bore 0.080 thou larger than the diameter of the torque amplify shaft (FIG. 11A), thus the outside of said bearing bushes (FIG. 12C) is threaded to a suitable size, either by lathe or hand die, to match a nut (FIG. 12C) of corresponding thread, size and material.

The operating shaft (FIG. 11A) is machined, turned upon lathe from steel similar material rod as per FIG. 11 A, thus blank said operating shaft (FIG. 11A) is then drilled and tapped through the vertical and horizontal axis 90 degrees to corresponding threaded holes as per FIG. 11 A.

Figure 9A:
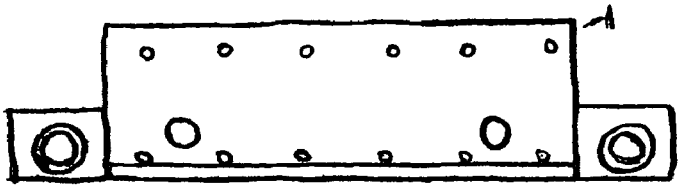
FIG. 9A; shows a front view of standard version of presented invention element 1 vertical linear plate FIG. 9B; shows a rear view of standard version of presented invention element 1 vertical linear plate FIG. 9C; shows a plan view of standard version of presented invention element 1 vertical linear plate FIG. 9D; shows a side/back view of standard version of presented invention element 3 tremolo tail stop conrod pivot.
Figure 9B:
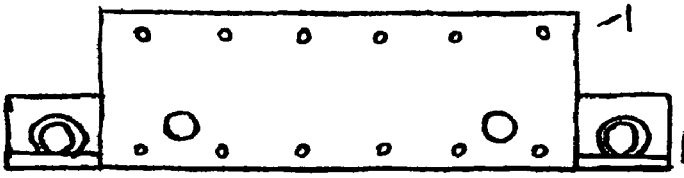
FIG. 9E; shows a side view of standard version of presented invention element 1 vertical linear plate FIG. 10A; Shows a side view of presented invention arm.
Figure 9C:
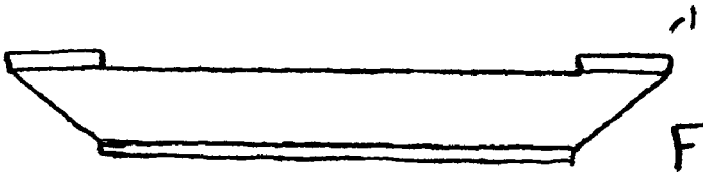
Figure 9D:
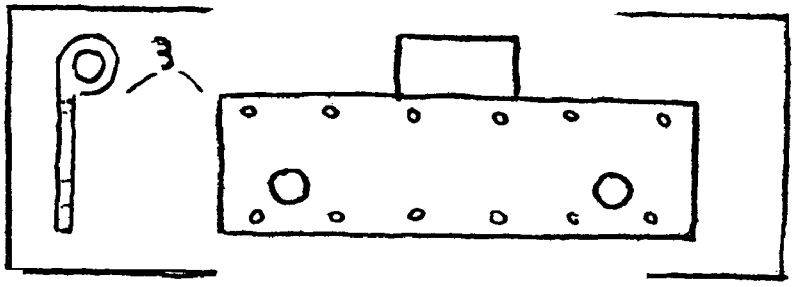
Figure 9E:
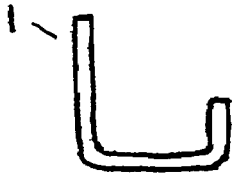
Figure 25A:
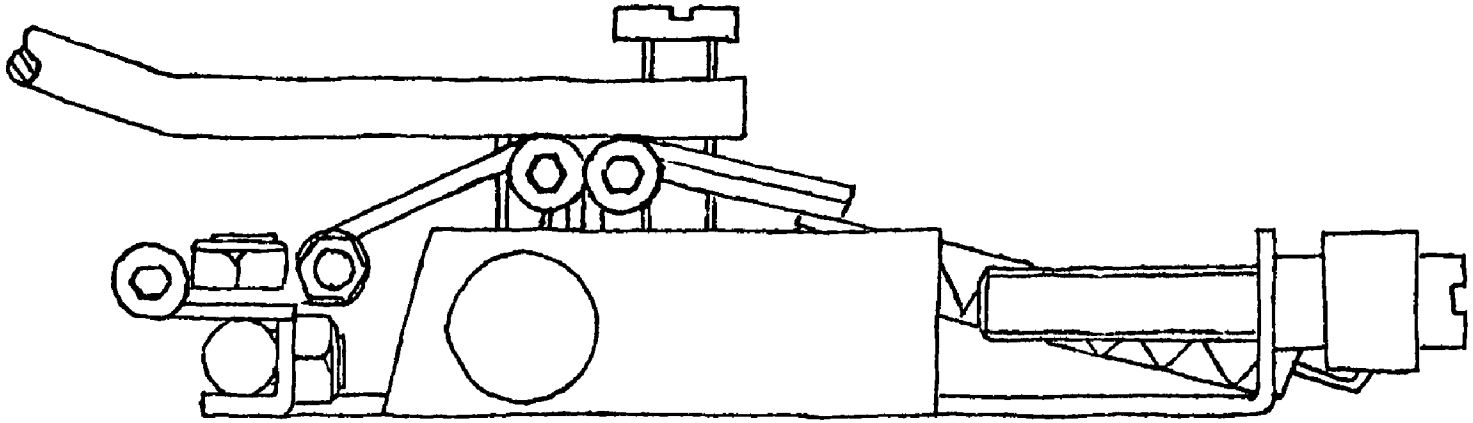
FIG. 25A; Shows a side view of non operating side of through instrument strung tune-o-matic variant of presented invention without cover.
Figure 25B:
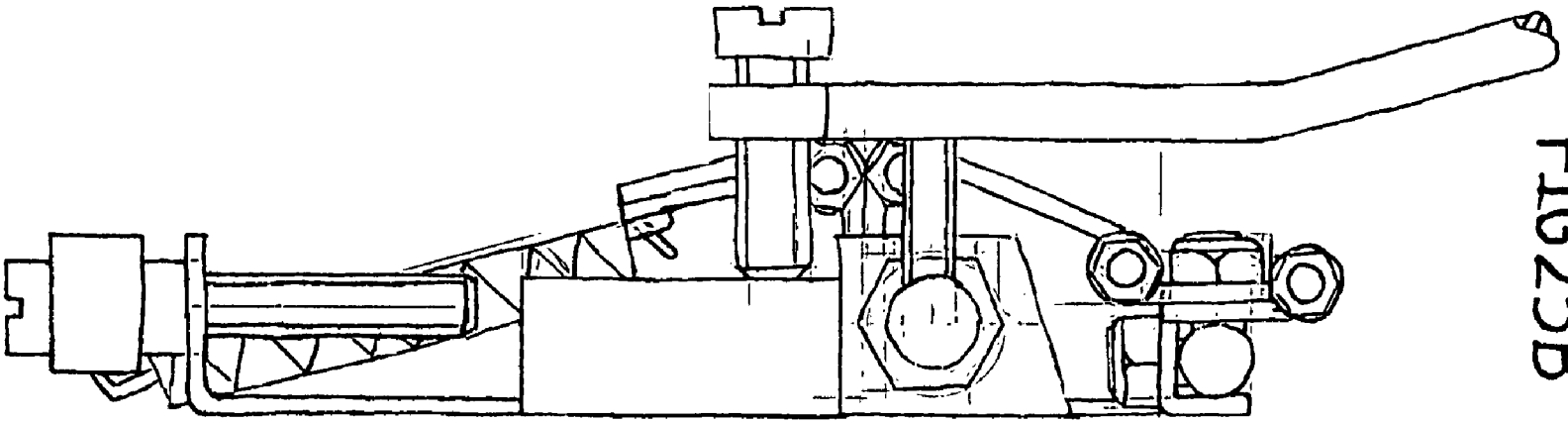
FIG. 25B; Shows a side view of operating side of through instrument strung tune-o-matic variant of presented invention without cover.

The tremolo tail stop (FIG. 9A, 9B, 9C) is made from 2 mm minnimum sheet steel, suitable metal, then marked out as per FIG. 9A, FIG. 9B, FIG. 9C, all excess material is removed via blade or machine punch, to which all burrs are removed clearance holes drilled as per FIG. 9A, FIG. 9B, FIG. 9C then required part of is then folded 90 degrees verticaly as per fig FIG. 9E, yet also may be made to thus fold from the opposite direction as used per FIG. 25A, FIG. 25B, FIG. 27C if tremolo tail stop (FIG. 9A, FIG. 9B, FIG. 9C) is desired to be in line with the front of presented invention thus this modification may be done to all variants.

The pivot pieces (FIG. 12*a*) for rotation of tremolo tail stop (FIG. 9A, FIG. 9B, FIG. 9C) are manufactured from brass/phosphor bronze or similar material, thus each half is milled and turned as per FIG. 12A, from suitable rod lengths of said material which are then threaded as per FIG. 12A, via corresponding die.

All broad pivot and hinge parts (FIG. 9D, FIG. 11B, FIG. 11C, FIG. 11D, FIG. 11E, FIG. 11F, FIG. 11G, FIG. 22B, FIG. 23B, FIG. 26B, FIG. 26C, FIG. 26D) are made from brass, phosphor bronze or similar material blocks, of a suitable size and are then milled and drilled to FIG. 9D, FIG. 11B, FIG. 11C, FIG. 11D, FIG. 11E, FIG. 11F, FIG. 11G, FIG. 22B, FIG. 23B, FIG. 26B, FIG. 26C, FIG. 26D individually to quantity required.

The spring hook (FIG. 11H, FIG. 11I) is made from 2 mm minimum sheet steel, suitable metal, then marked out as per FIG. 11H, FIG. 11I, thus hook is cut, machine punched out flat, with clearance holes, individual hooks are then folded to a suitable angle as per FIG. 11H and finaly deburred.

The spring adjustment bar (FIG. 8A) is made from a single square bar of steel, suitable material, which is then marked out as per FIG. 8A, then milled and drilled with clearance holes and slots as per FIG. 8A, before being deburred to compleate construction of spring adjustment bar, which may also be cast and cleaned up.

The spring adjustment pins (FIG. 8B) are made from steel, suitable metal rod material whence they are turned upon lathe to suitable stepped diameters, before a suitable thread is cut, using lathe or die, upon the longest blank, thus producing a pin as per FIG. 8B The conrod (FIG. 11J, FIG. 22C, FIG. 22D) is made from a rod of steel or preferred high tensile steel, suitable metal rod of preferred diameter FIG. 11J, FIG. 22C, FIG. 22D, to either end of rod a threaded bolt, caphead bolt is welded at 90 degrees parallel to each other and facing the same direction, yet also welding is only done from top of bolt head to preserve flat beneath bolt, also said high tensile steel is preferred suitable high tensile welding rod must be used, but said conrod (FIG. 11J, FIG. 22C, FIG. 22D) must not be quenched as this will result in brittle con-rod (FIG. 11J, FIG. 22C, FIG. 22D), yet this item may be cast and threaded from mould if preferred by manufacturer.

The presented invention stop plate (FIG. 8C) is made from 2 mm minimum sheet steel, suitable material sheet, marked out as per FIG. 8C fig, then cut, machine punched out, before being drilled to a clearance size (FIG. 8C), folded as per FIG. 8C, and finally deburred.

Figure 10B:
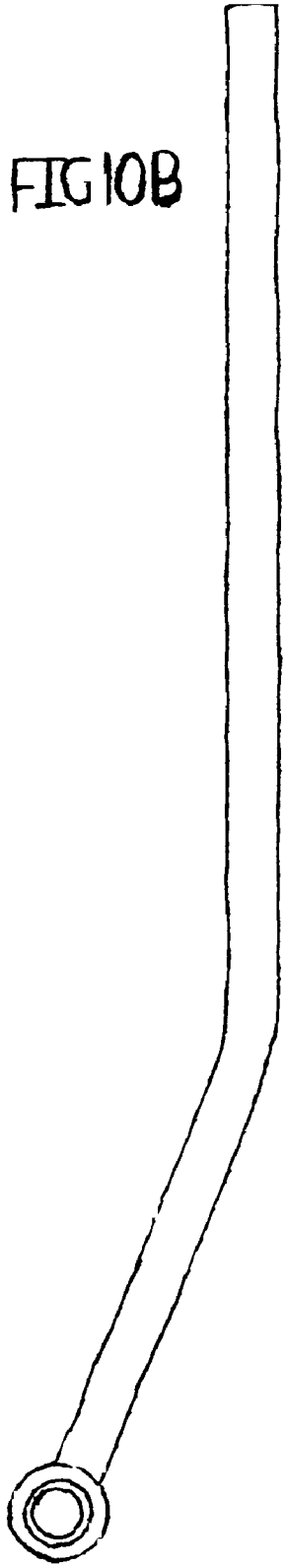
FIG. 10B; shows a plan view of presented invention arm.
Figure 10A:
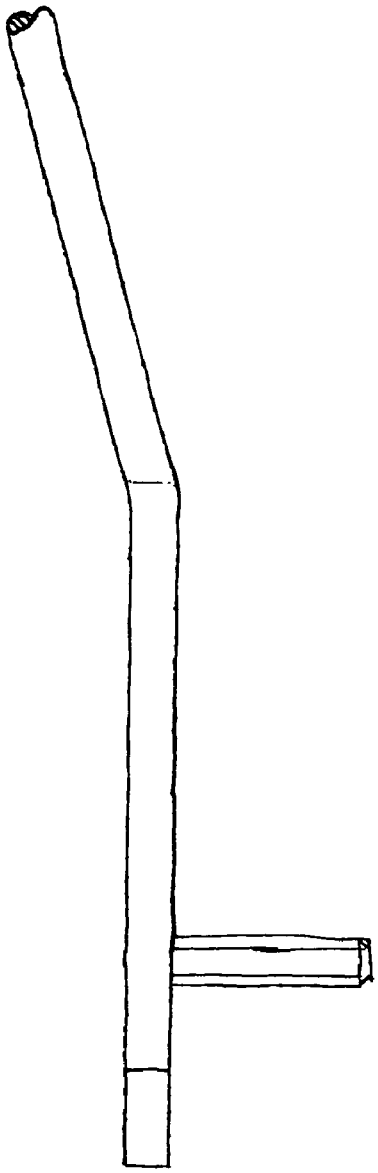
FIG. 10C; shows a side view of presented invention stop plate.

The arm (FIG. 10A, FIG. 10B) is constructed from a rod of steel, suitable metal, to which a shorter threaded rod (FIG. 10A, FIG. 10B) is welded to at 90 degrees to the longer rod, which is thus allowed to air cool, to which a threaded bush then welded to the end of long rod, to the end nearest threaded rod, thus allowing a suitable set pin to be screwed into the welded threaded bush thus producing an adjustable tail piece (FIG. 10C) and completing said arm FIG. 10A, FIG. 10B.

Figure 15:
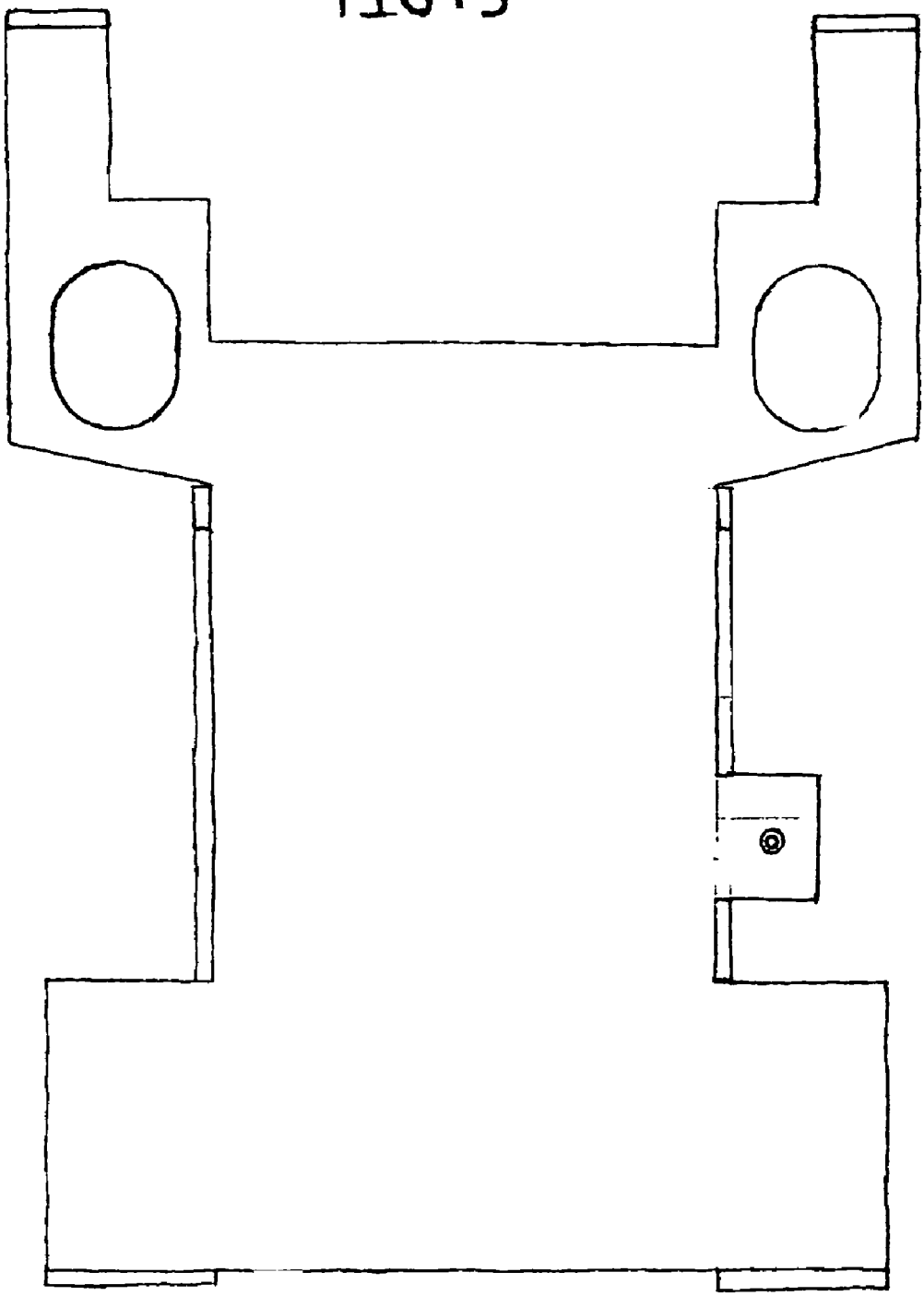
FIG. 15; Shows a plan view of bridge saddle variant of frame of presented invention.
Figure 17A:
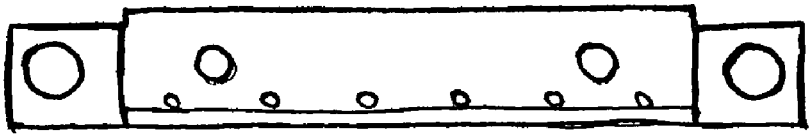
FIG. 17A; shows a front view of bridge saddle variant presented invention folded tremolo tail stop steel sheet.
Figure 17B:
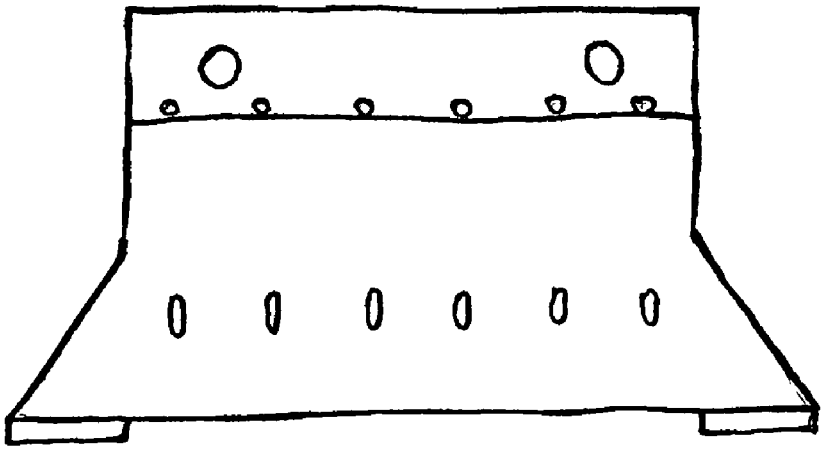
FIG. 17B; shows a plan view of bridge saddle variant presented invention folded tremolo tail stop steel sheet.
Figure 17C:
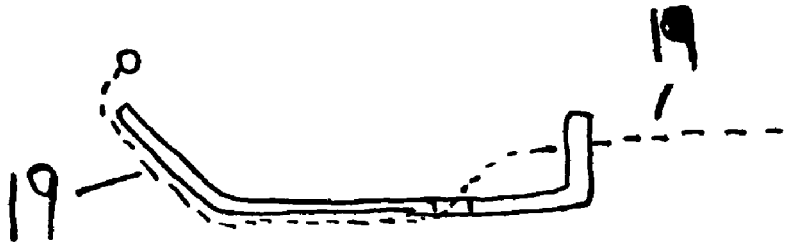
FIG. 17C; shows a side view of saddle variant presented invention vertical linear plate with previously omitted element 19 dashed line to indicate passage instrument string through bridge saddle variant presented invention folded tremolo tail stop steel sheet.

All variants comprise of the same materials as said standard versions (FIG. 2, FIG. 5, FIG. 6, FIG. 7), thus bridge saddle tremolo tail stop (FIG. 13A, FIG. 13B, FIG. 13C) is made from 2 mm sheet steel, suitable material which is then, marked out, drilled, cut and folded as per FIG. 21A, FIG. 21B, FIG. 21C, and such the conrod pivot (FIG. 22A) is made in the same way as FIG. 9D, yet to FIG. 22A, designation and thus the variant conrod (FIG. 22C) is constructed using the same methods and materials as FIG. 11J, thus variant frame (FIG. 15) is made the same way as FIG. 12B.

Figure 2:
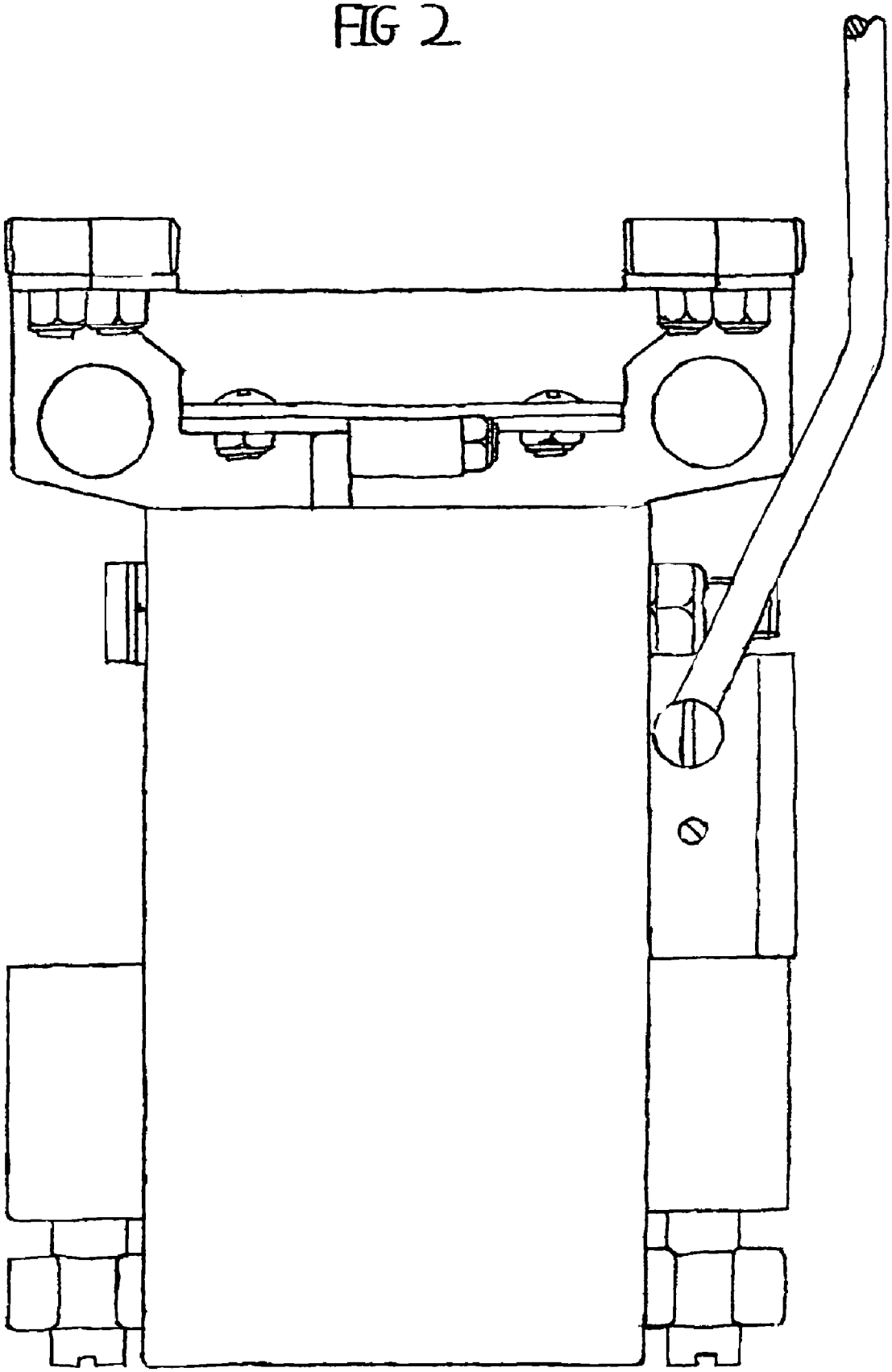
FIG. 2; Is a plan view of the standard version Thunderline bolt on tremlo system with cover.
Figure 3A:
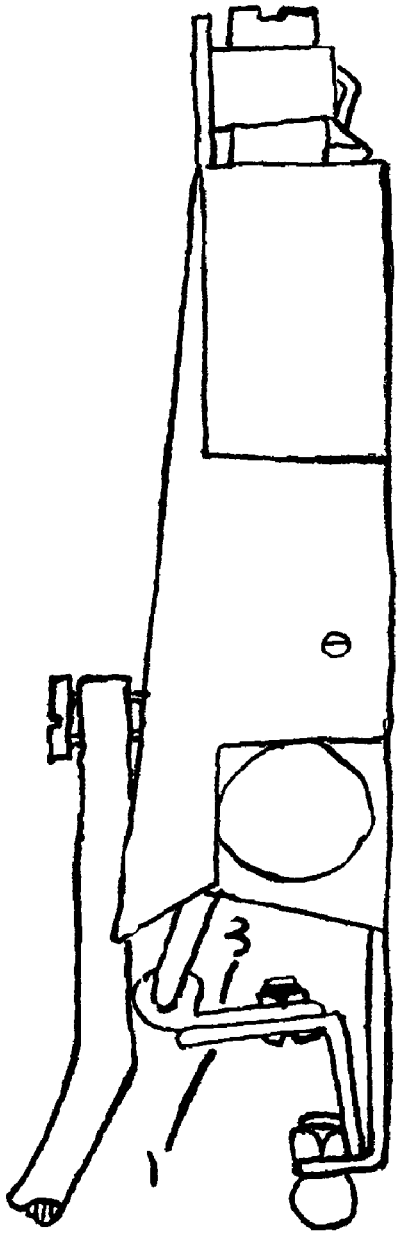
FIG. 3A; Shows a side view of the non operating side of standard version of presented invention with cover including element 1 folded tremolo tail stop steel sheet, element 3 tremolo tail stop conrod pivot.
Figure 3B:
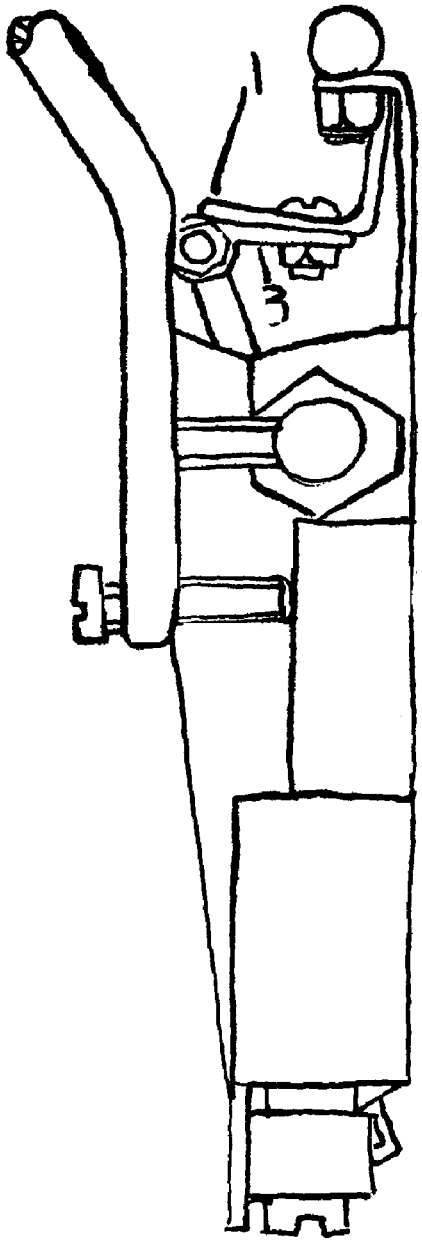
FIG. 3B; Shows a side view of the operating side of standard version of presented invention with cover including element 1 vertical linear plate.
Figure 4A:
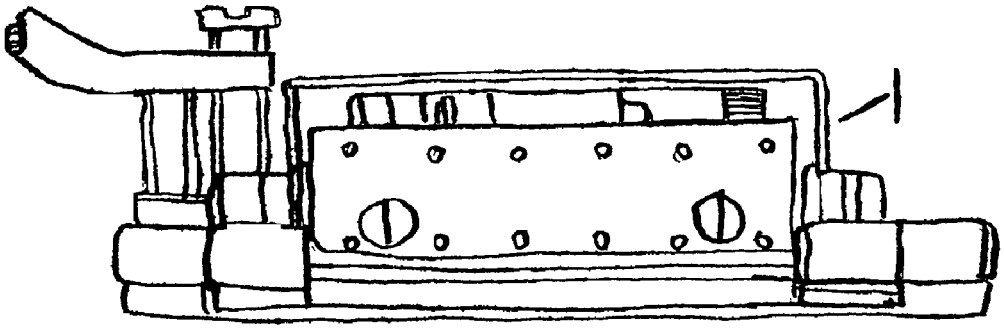
FIG. 4A; Shows a front view of standard version of presented invention with cover.
Figure 4B:
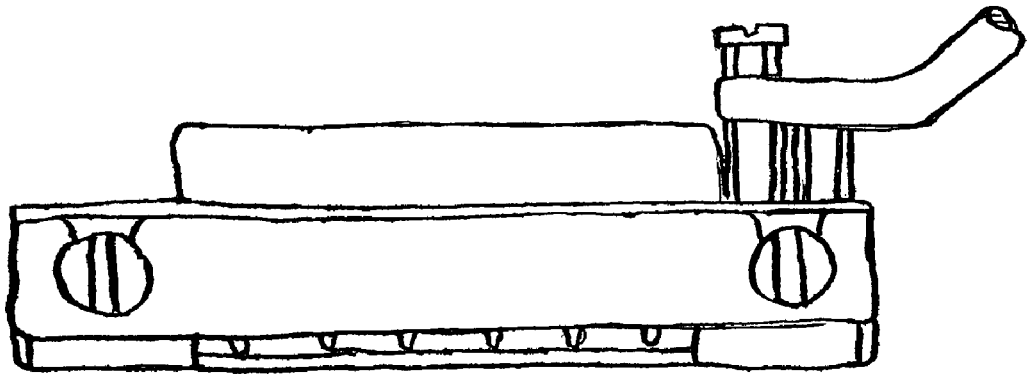
FIG. 4B; Shows a rear view of standard version of presented invention with cover.
Figure 5:
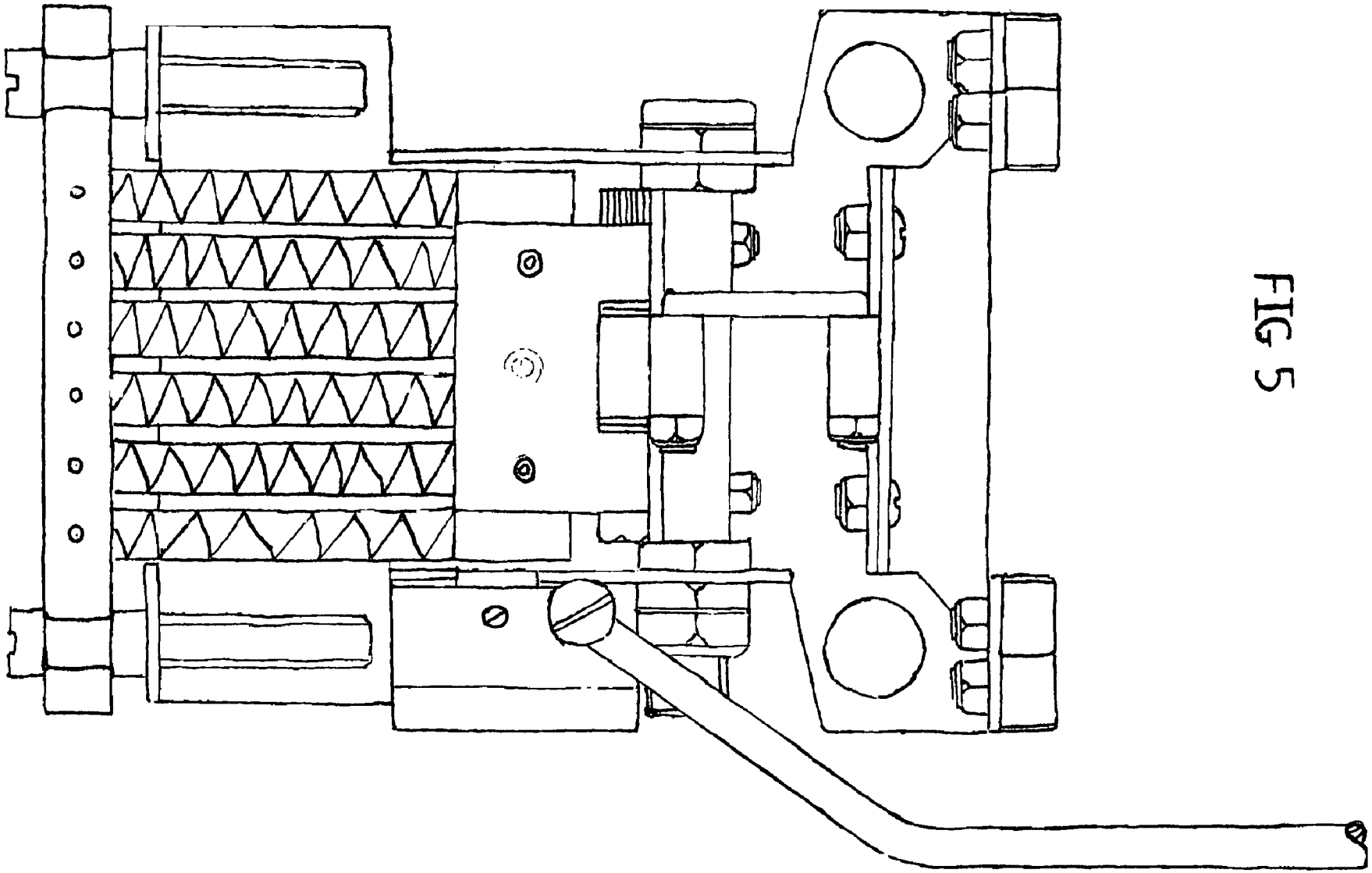
FIG. 5; Shows a plan view of standard version of presented invention without cover.
Figure 6A:
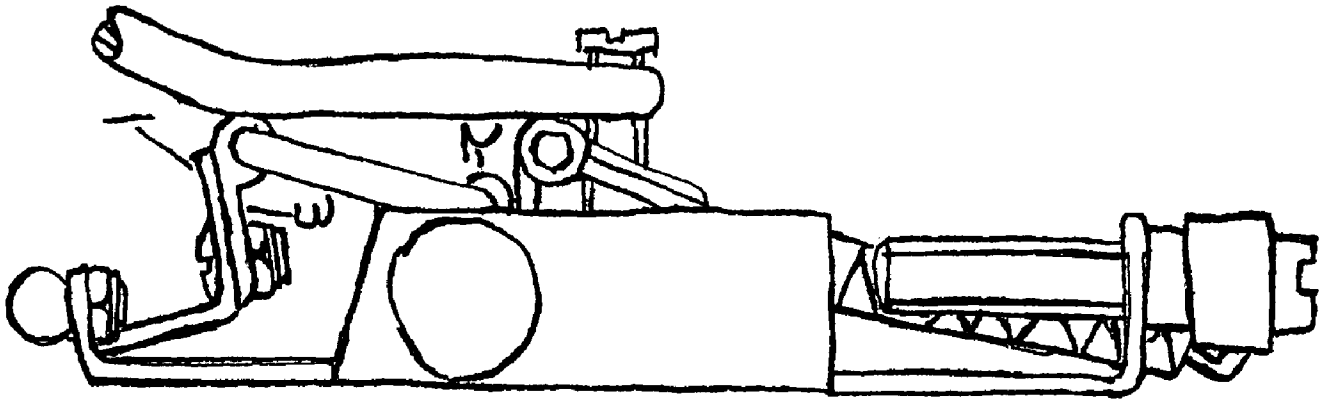
FIG. 6A; Shows a side view of the non-operating side of standard version of presented invention without cover including element 1 folded tremolo tail stop steel sheet, element 3 tremolo tail stop conrod pivot. Previously omitted element 2 operating shaft conrod hinge.
Figure 6B:
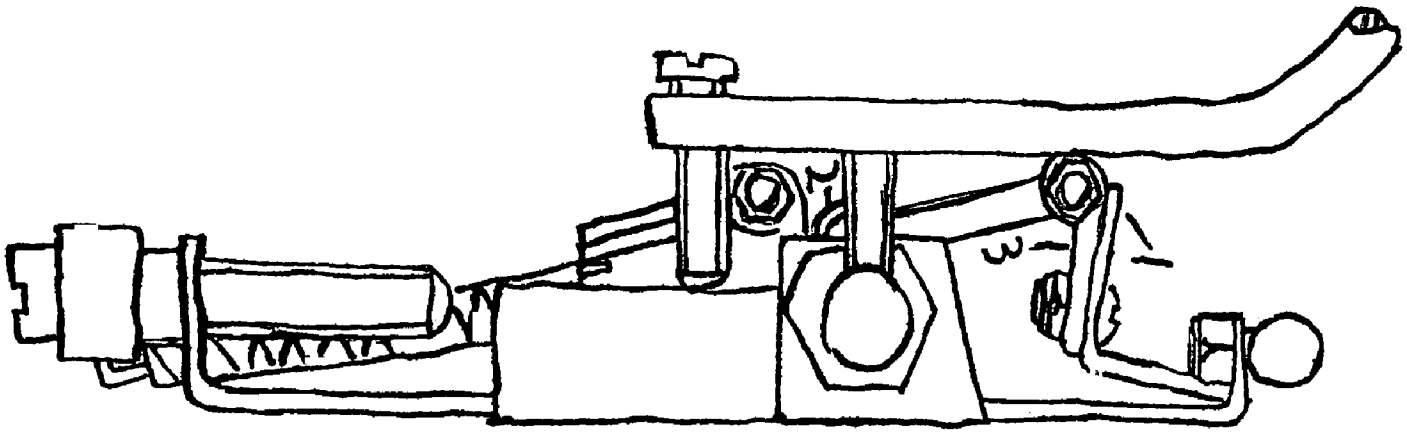
FIG. 6B; Shows a side view of the operating side of standard version of presented invention without cover including element 1 folded tremolo tail stop steel sheet, element 3 tremolo tail stop conrod pivot Previously omitted element 2 operating shaft conrod hinge.
Figure 7A:
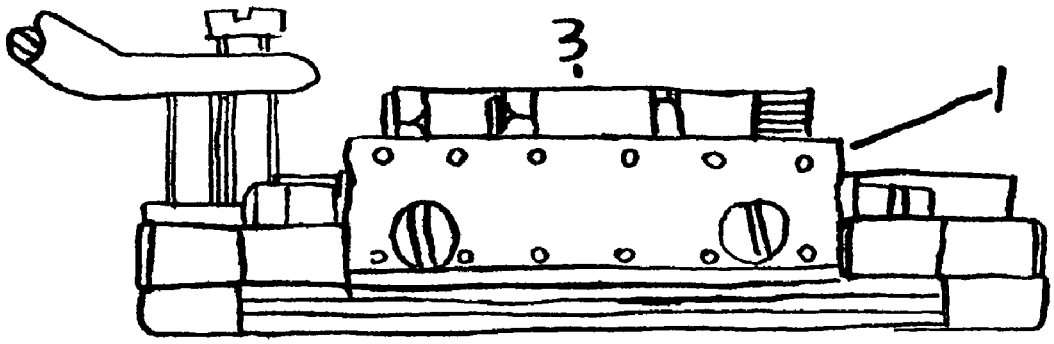
FIG. 7A; Shows a front view of presented invention without of cover including element 1 folded tremolo tail stop steel sheet, element 3 tremolo tail stop conrod pivot.
Figure 7B:
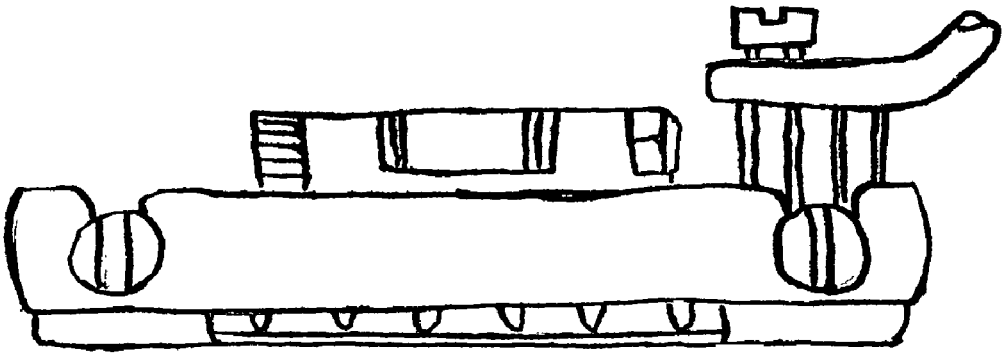
FIG. 7B; Shows a rear view of presented invention without cover.
Figure 23A:
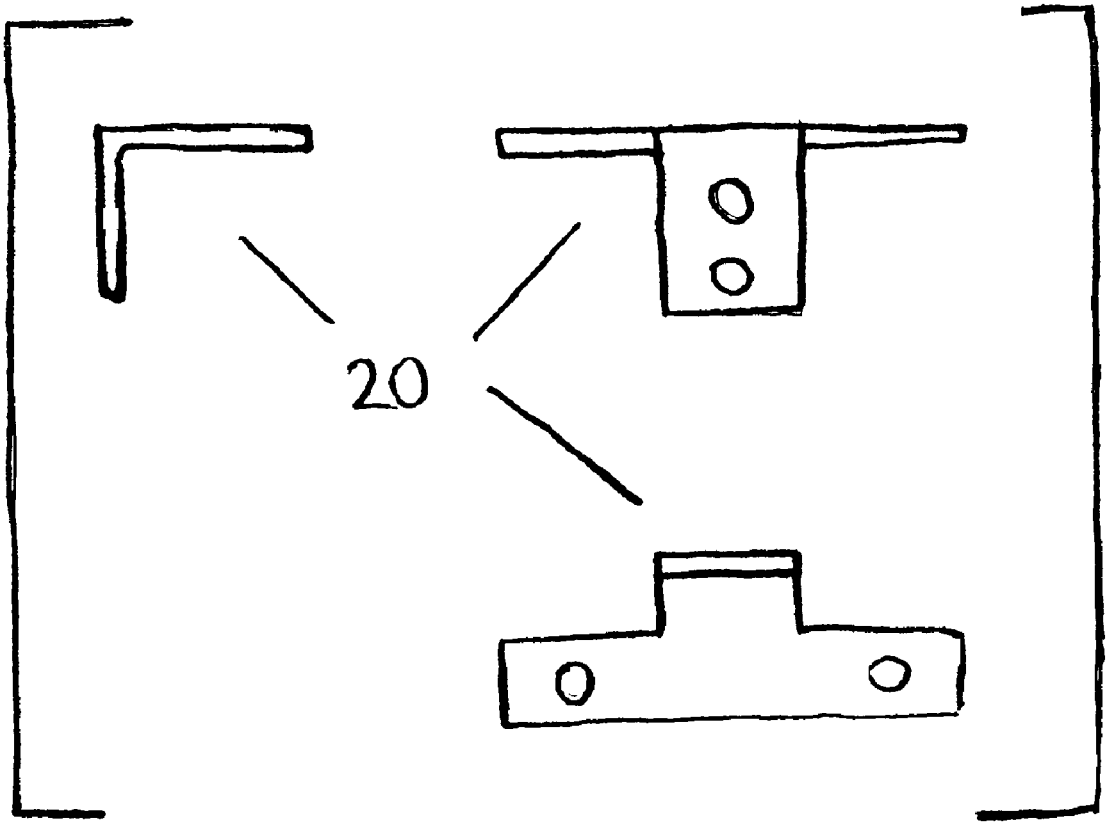
FIG. 23A; Shows a side view of through instrument strung variant operational previously omitted element 20 shaft bracket.
Figure 23B:
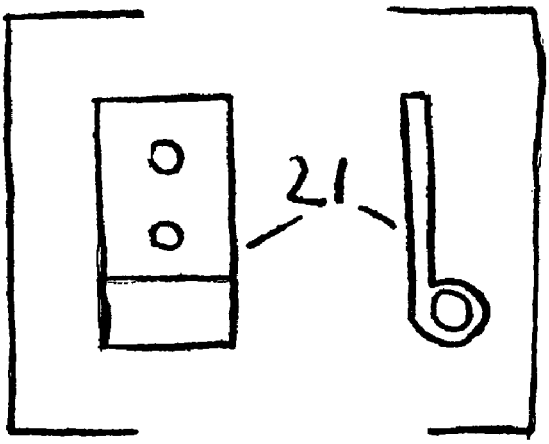
FIG. 23B; Shows a plan view of through body strung previously omitted element 21 operational shaft conrod pivot variant.

The trough body strung bridge saddle variant is made all the same materials as said standard version FIG. 2, thus the tremolo tail stop (FIG. 21A, FIG. 21B, FIG. 21C) is made from 2 mm sheet steel or suitable material is measured, marked out, drilled cut and folded as per FIG. 21A, FIG. 21B, FIG. 21C, thus the conrod pivot is been constructed using the same materials and methods as per FIG. 22, yet to FIG. 22B, and thus the operational shaft conrod pivot (FIG. 23B), is constructed from a mild steel sheet, suitable material and manufactured via marking out as FIG. 23A, cutting or punching out and folding, thus producing FIG. 23A, along with FIG. 23B, which is constructed using same methods and materials as FIG. 9D, therein conrod FIG. 22D is constructed using the same methods and materials as FIG. 11J, thus frame (FIG. 20) is constructed using the same materials and methods as per FIG. 12B.

Figure 26A:
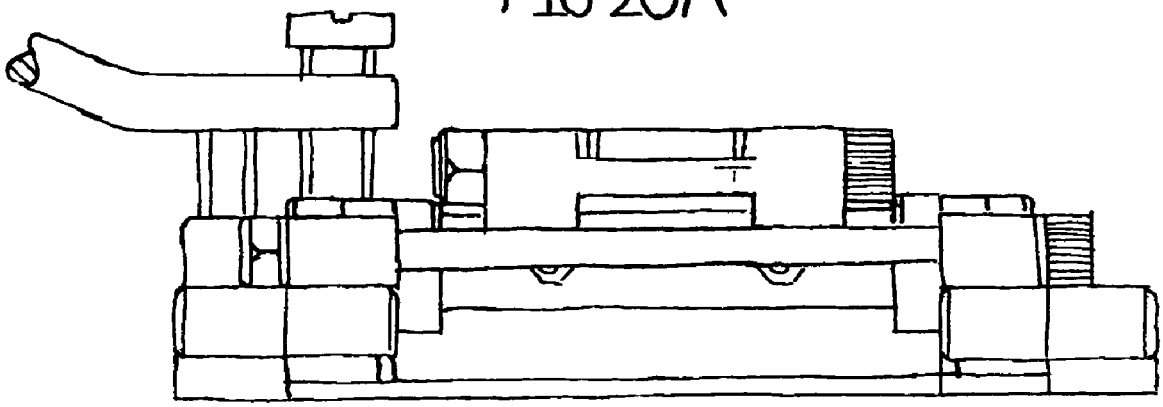
FIG. 26A; Shows a front view of through instrument strung tune-o-matic variant of presented invention without cover.
Figure 26B:
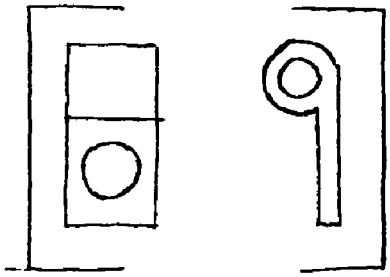
FIG. 26B; Shows plan and side views of through instrument strung variant roller bar pivot pieces.
Figure 26C:
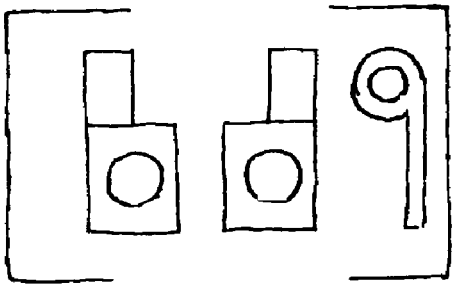
FIG. 26C; Shows plan and side views of through instrument strung tune-o-matic variant tie bar connectors.
Figure 26D:
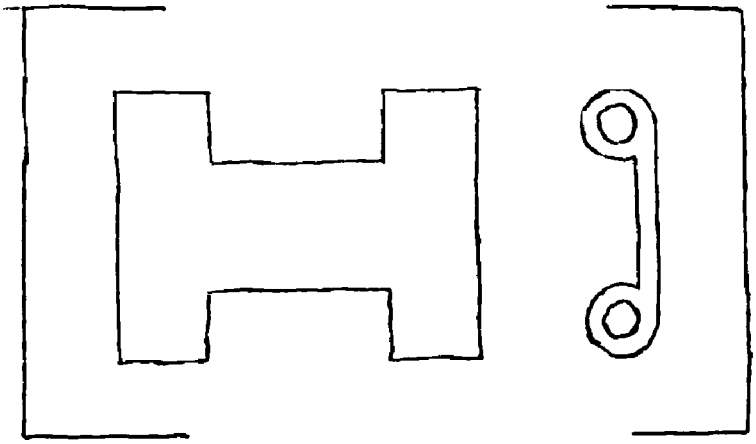
FIG. 26D; Shows plan and side views of through instrument strung tune-o-matic variant conrod instrument strung tune-o-matic variant conrod.

The through instrument strung fixed intonation style variation (FIG. 24) hinge parts (FIG. 26B, FIG. 26C) are constructed in the same way, suitable materials as FIG. 9D, yet are cut and drilled as variant FIG. 26B, FIG. 26C as is the flat con-rod (FIG. 26D) to which corresponding tie bar (FIG. 27B) is made from a single suitable rod of steel, suitable material, threaded at either end as per FIG. 27B, to accomadate two corresponding lock nuts at either end, thus the presented invention roller bar (FIG. 27A) that can be either a standard stock corresponding cap head bolt, or constructed the same as FIG. 27B, thus frame (FIG. 27C) is constructed using the same methods as FIG. 12B.

Assembley of the Thunderline bolt on tremlo system (FIG. 2) begins with folded frame of preffered designation (FIG. 12B), onto which both bearing bushes (FIG. 12C) are bolted securely to each long side accommodating hole, thus allowing the operating shaft (FIG. 11A) to slide through both bearing bushes (FIG. 12C), whilst retaining a washer against the outside of each said bearing bolt, retaining ease of rotation.

Further assembley of presented invention system requires brass hinge pieces (FIG. 11B, FIG. 11C, FIG. 11D, FIG. 11E, FIG. 11F, FIG. 11G) and hook (FIG. 11H,FIG. 1J) to be assembled upon each other and operating shaft (FIG. 11), thus operating shaft conrod hinge (FIG. 11B, FIG. 11C) along with spring tension pivot (FIG. 11D FIG. 11E) are bolted to the rear of operating shaft (FIG. 11A), using standard countersunk caphead set pins and corresponding retaining nylon lock nuts, thus hook hinge (FIG. 11F, FIG. 11G) is secured to said spring tension pivot (FIG. 11D FIG. 11E) using standard stock cap head bolt whilst fitting corresponding washers either side of said spring tension pivot (FIG. 11D FIG. 11E) to reduce wear and friction wherein said cap head bolt is retained using suitable nylon lock nut, thus hook (FIG. 11H, FIG. 1J) is riveted to hinge (FIG. 11F, FIG. 11G).

Figure 1:
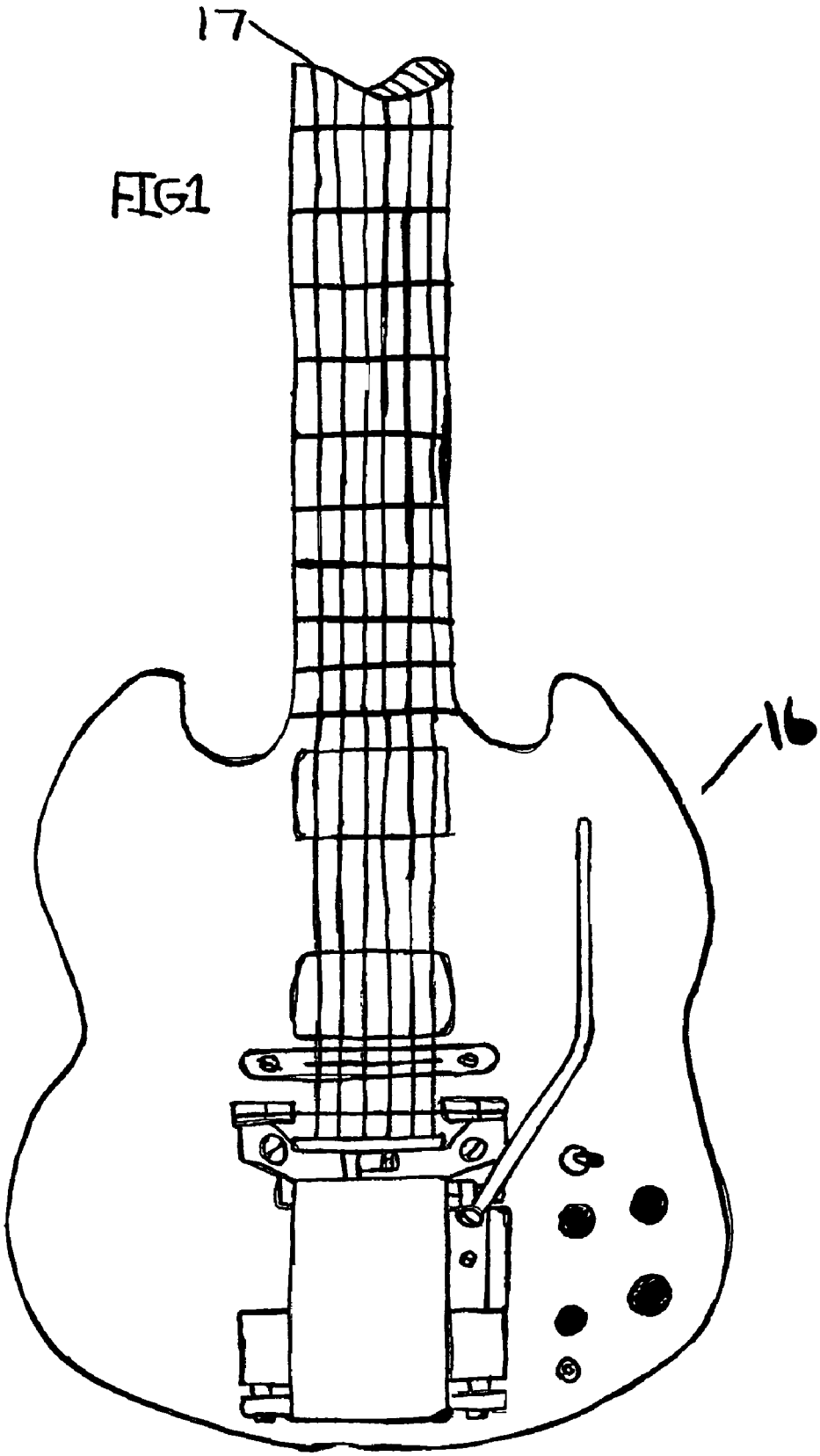
FIG. 1; Shows a plan view of the standard version of the Thunderline bolt on tremlo system fitted on top of the stringed instrument with instrument strings attached, previously omitted element 16 a stringed instrument with previously omitted element 17 instrument string.

Further assembley of presented invention system is achieved by chosen frame (FIG. 12B) thus both adjustment pins (FIG. 8B) are parallel with long sides of said chosen frame, thus spring adjustment bar (FIG. 8A) may be fitted vertically from base of frame whilst spanning the complete width of chosen frame (FIG. 12B) fitting home inbetween both rear shoulders of each spring adjustment pins (FIG. 8B), thus allowing all six expansion springs (FIG. 21D) to be fitted from hook FIG. 11H,FIG. 1J) to adjustment bar (FIG. 8A), wherein eye of said spring (FIG. 21D) fits over hook (FIG. 11H,FIG. 1J), ninety degree hook end of said spring FIG. 21D, thus spring tension is connected to operational shaft FIG. 11A.

Further assembly of presented invention system is achieved by fitting one half of each pair of pivot piece (FIG. 12A) to the front of chosen tremolo frame (FIG. 12B) and secured into place with suitable corresponding nylon lock nut, thus second half of each pair of pivot pieces (FIG. 12A) is slid on, into first half wherein tremolo tail stop of chosen design (FIG. 9A, FIG. 9B, FIG. 9C, FIG. 9E) is secured using suitable nylon lock nut thus allowing tremolo tail stop (FIG. 9A, FIG. 9B, FIG. 9C, FIG. 9E) to pivot upon frame, wherein conrod tremolo tail stop pivot FIG. 9D is riveted to chosen said tremolo vertical linear plate (FIG. 9A, FIG. 9B, FIG. 9C, FIG. 9E) accordingly, thus suitable con rod (FIG. 11J) may be fitted between said operational shaft conrod hinge (FIG. 11C) and tremolo tail stop conrod pivot (FIG. 9D) from non operating side to operating side and thus retained into place with corresponding nylon lock nuts.

Further assembly of presented invention system is achieved by screwing arm (FIG. 10A, FIG. 10B) into threaded coupling of operational shaft (FIG. 11A) to the required height and screwing adjustable tail piece (FIG. 10C) into rear of arm (FIG. 10A, FIG. 10B) wherein tremolo cover (FIG. 28A, FIG. 28B, FIG. 29A, FIG. 29B, FIG. 29C) is then fitted and retained via two small slotted set pins upon either side of presented invention (FIG. 2), thus presented invention stop plate (FIG. 8C) is retained with suitable set pin and thus presented invention adjustable tail piece (FIG. 10C) is placed upon presented invention said stop plate (FIG. 8C), to which spring tension is taken up with said adjustment pins (FIG. 8B) to desired amount.

Figure 13:
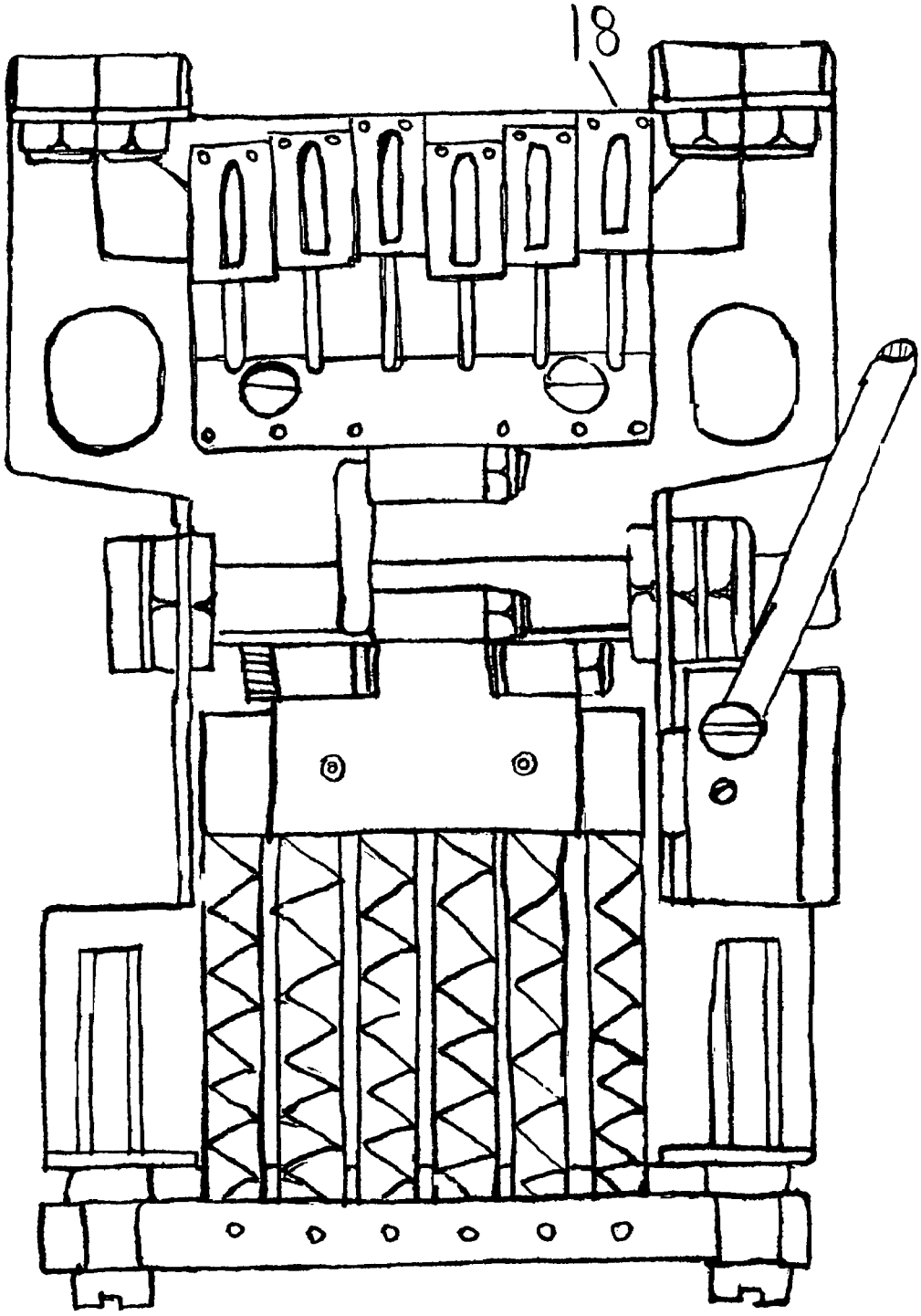
FIG. 13; Shows a bridge saddle variant of presented invention previously omitted element 18 a bridge saddle.
Figure 14A:
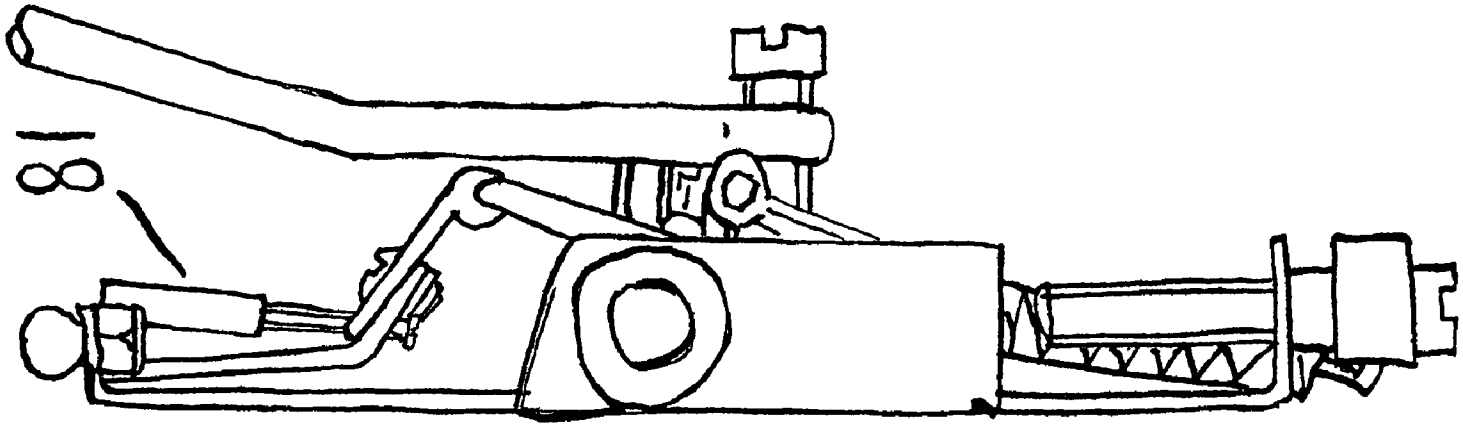
FIG. 14A; Shows a side view of non operating side of bridge saddle variant of presented invention without cover including element 2 operating shaft conrod hinge, previously omitted element 18 a bridge saddle, Previously omitted element 2 operating shaft conrod hinge.
Figure 14B:
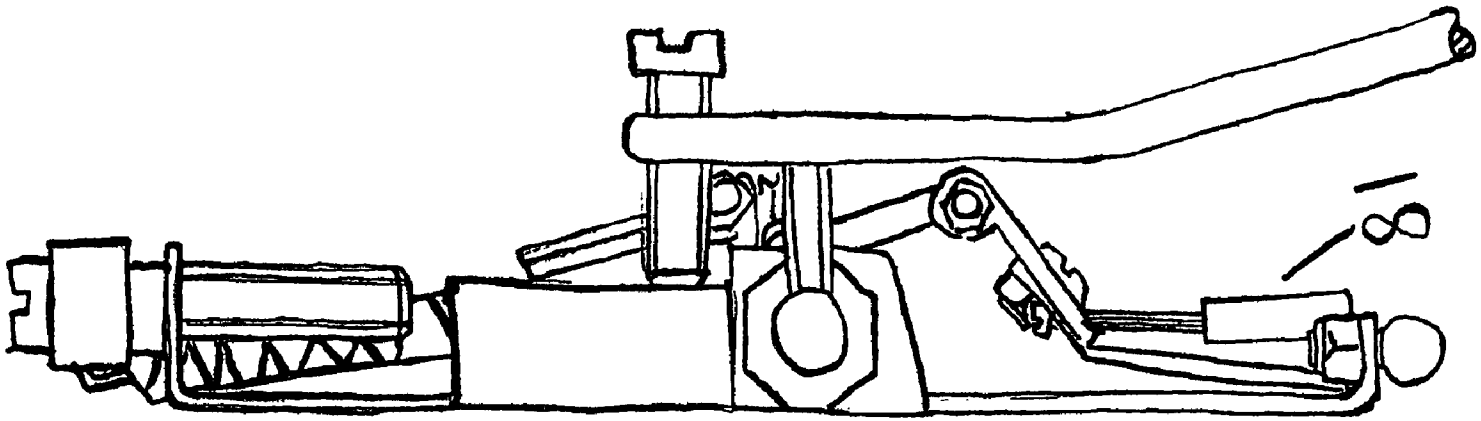
FIG. 14B; Shows a side view of operating side of bridge saddle variant of presented invention without cover including element 2 operating shaft conrod hinge, previously omitted element 18 a bridge saddle Previously omitted element 2 operating shaft conrod hinge.
Figure 18:
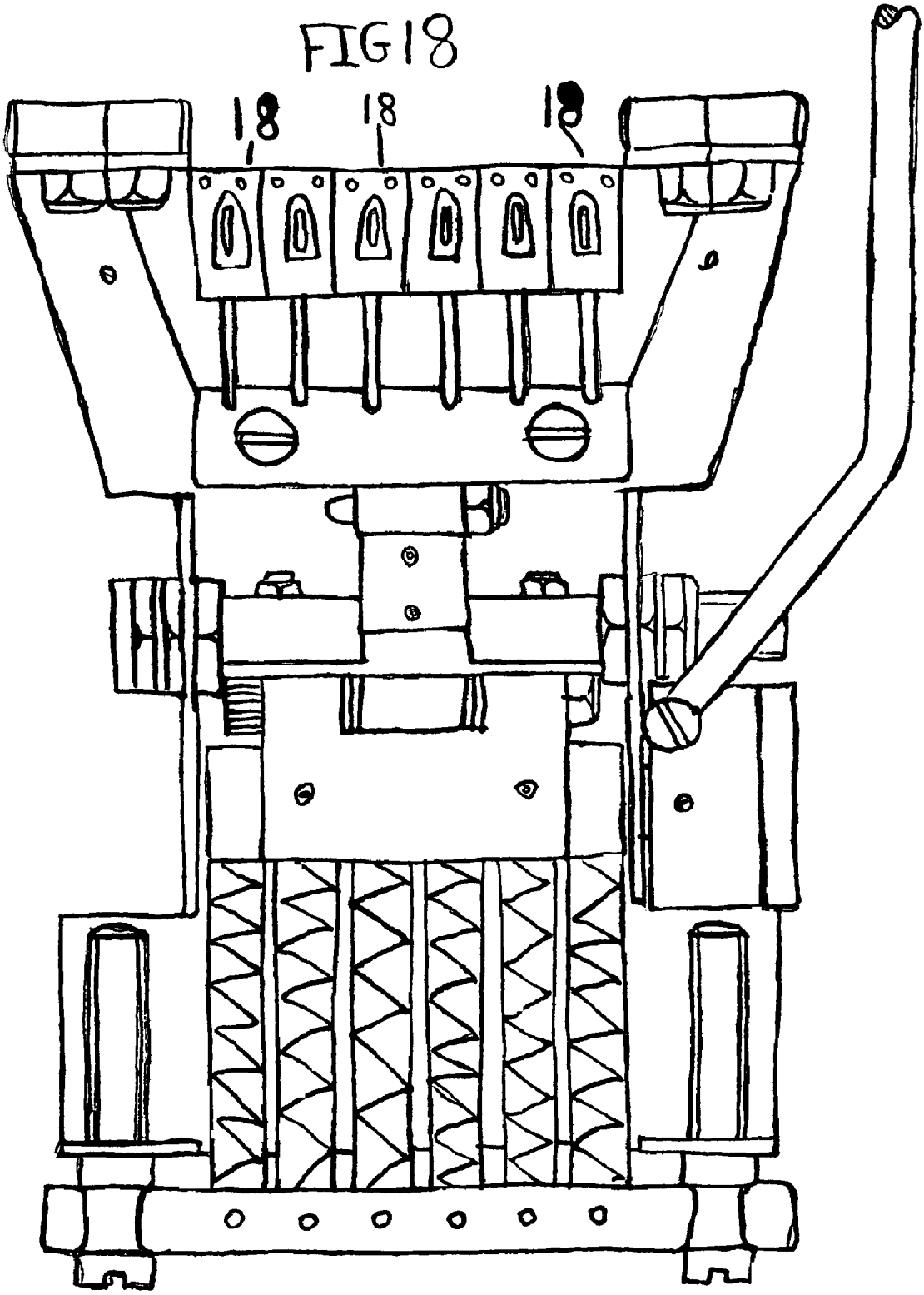
FIG. 18; Shows a plan view of through instrument strung bridge saddle variant of presented invention without cover including previously omitted element 18 a bridge saddle.
Figure 19A:
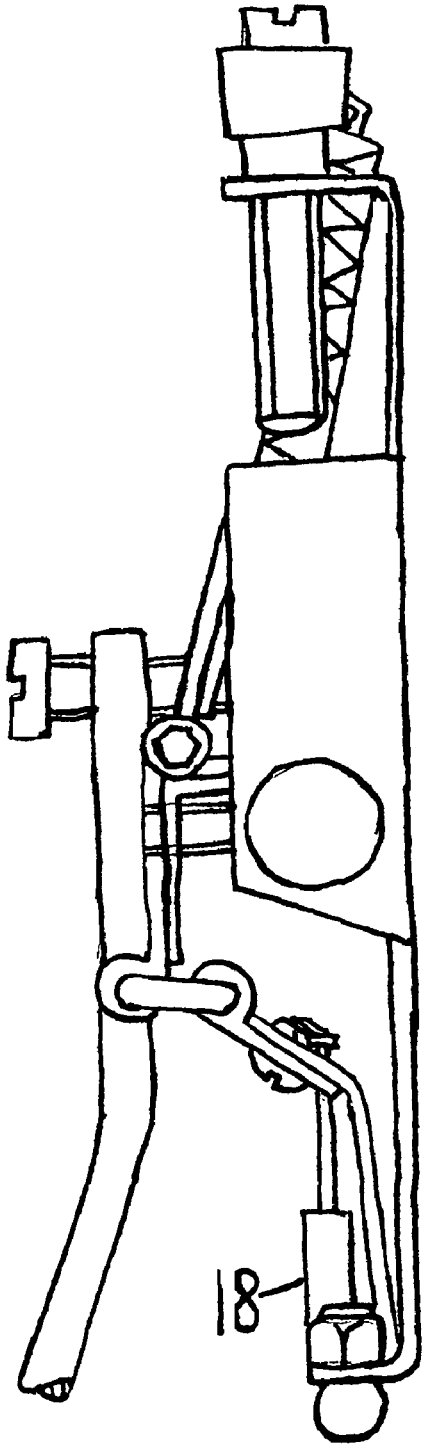
FIG. 19A; Shows a side view of non operational side of through instrument strung FIG. 18; Shows a plan view of through instrument strung bridge saddle variant of presented invention without cover including previously omitted element 18 a bridge saddle.
Figure 19B:
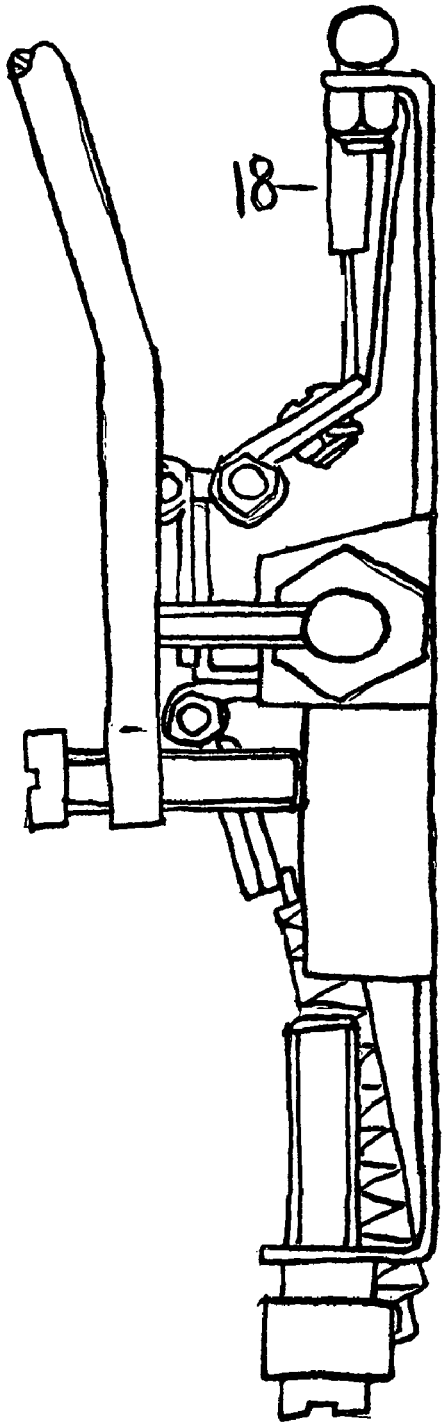
FIG. 19B; Shows a side view of operational side of through body instrument strung strung bridge saddle variant of presented invention without cover including previously omitted element 16 a bridge saddle.
Figure 24:
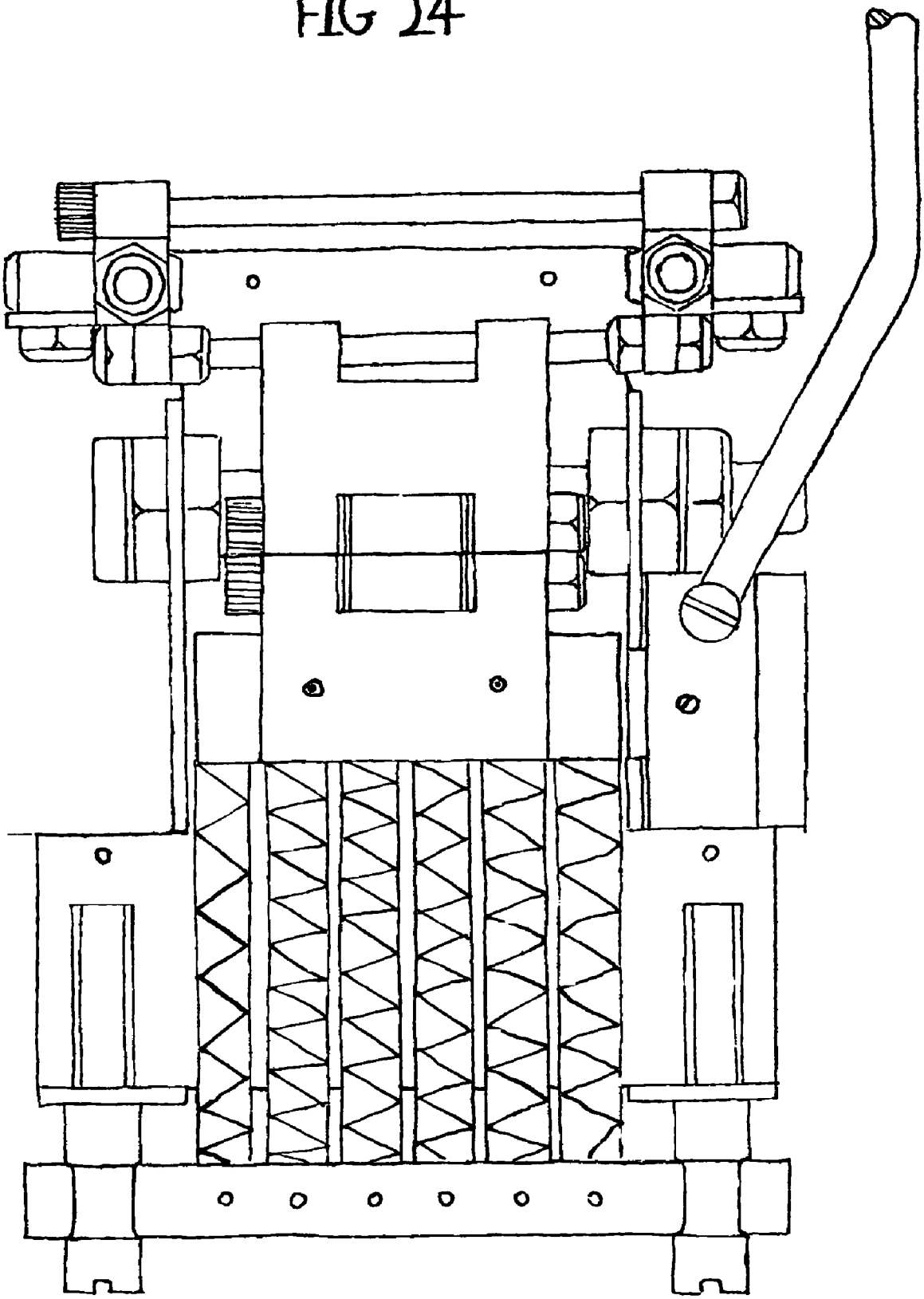
FIG. 24; Shows a plan view of through instrument strung tune-o-matic variant of presented invention without cover.

Variant assembley of presented inventions (FIG. 13, FIG. 18, FIG. 24) is the same as standard version (FIG. 2) with the exception of fitting bridge saddles to variations FIG. 13 and FIG. 18, yet through instrument strung bridge saddle variations (FIG. 18) requires variant operational shaft conrod hinge (FIG. 23B) and bracket (FIG. 23A) to be fitted, which extends directly above the variant bridge saddle tremolo tail stop (FIG. 21A, FIG. 21B, FIG. 21C), thus requiring variant con-rod (FIG. 22D) as does bridge saddle variant (FIG. 13) with con-rod (FIG. 22C, wherein through instrument strung tune o matic variation (FIG. 24) has its presented inventions tremolo tail stop fully assembled upon both inside hinge pieces (FIG. 12A) which point vertically up from said presented inventions frame (FIG. 27C), thus roller bar hinge piece (FIG. 26B) is placed over vertical shaft in a horizontal position pointing out beyond the front of the frame, to which the tie bar connectors (FIG. 26C) are laid on top of said roller bar pivots (FIG. 26B) yet pointing back towards the springs, with the bore of said connector on the inside, parallel with the centre line of presented inventions frame (FIG. 27C), thus nylon lock nut is used to retain both said FIG. 26B and FIG. 26C squarely upon hinge pieces (FIG. 12A) as flat con-rod (FIG. 26D) is fitted to standard operational shaft conrod hinge (FIG. 11B, FIG. 11C), thus allowing tie bar (FIG. 27B) to be slid through tie bar connectors (FIG. 26C) and flat con-rod (FIG. 26D), wherein it is secured firmly by four corresponding nylon lock nuts, thus roller bar (FIG. 27A) is slid through roller bar pivots (FIG. 26B) and retained with corresponding nylon lock nuts, yet allowing ease of rotation, thus connecting the assembled roller bar presented inventions vertical linear plate to said operational shaft, thus producing FIG. 24.

Figure 10C:
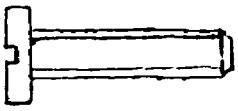
Figure 30A:
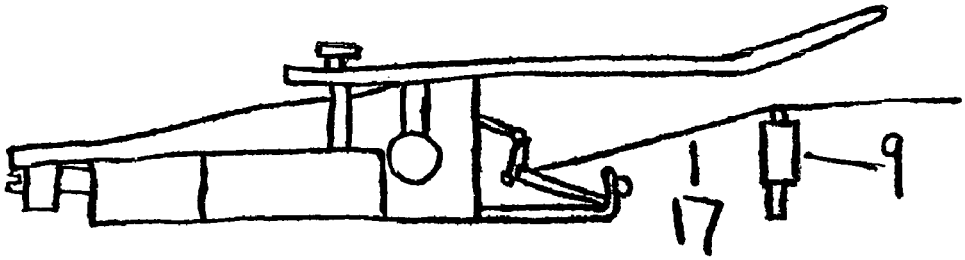
FIG. 30B; Shows presented invention in operational position to lower string tension and pitch previously omitted element 9 a bridge with previously omitted element 17 a string.
FIG. 30C; Shows plan view of presented invention in operational position to raise string tension and pitch previously omitted element 9 a bridge, with previously omitted element 17 a string.
Figure 30B:
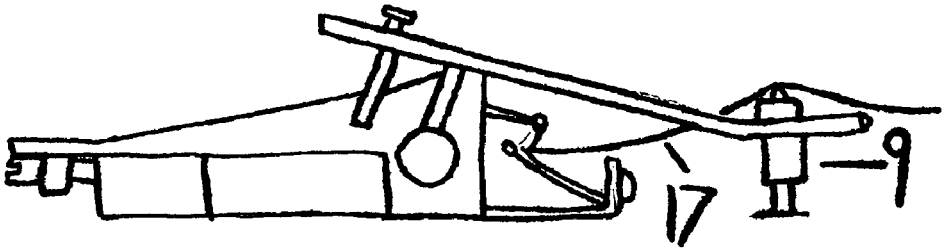
Figure 30C:
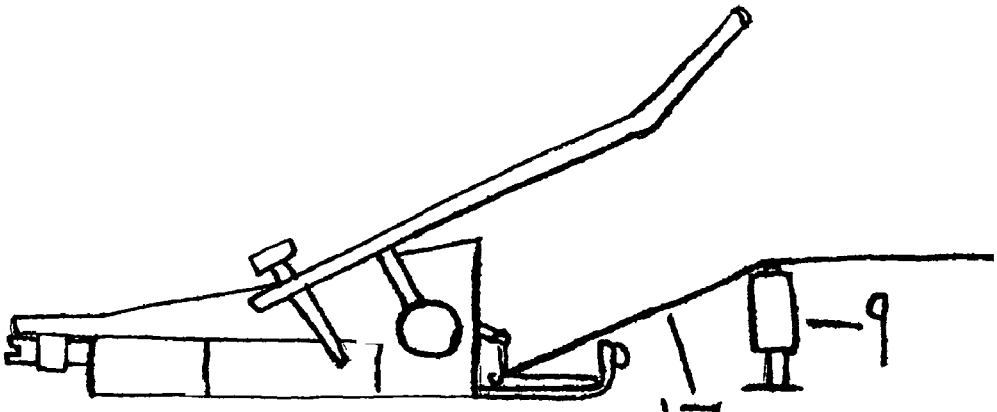

To operate thus making pitch lower, strum guitar and pull arm (FIG. 10A, FIG. 10B) across instrument strings, thus lifting stop pin FIG. 10C up and away from stop plate FIG. 8C wherein operating shaft FIG. 11A is rotated towards said tremolo tail stop folded steel sheet FIG. 9A, FIG. 9B, FIG. 9C FIG. 9E, thus pulling against said springs FIG. 21D through pivot and hook FIG. 11F, FIG. 11G, FIG. 11H, FIG. 11I assembly, whilst pushing said conrod FIG. 11J forward towards tremolo tail stop FIG. 9A, FIG. 9B, FIG. 9C FIG. 9E, thus in turn pushing the tremolo tail stop FIG. 9A, FIG. 9B, FIG. 9C FIG. 9E forwards towards the guitar bridge, which in turn slackens strings as per FIG. 30B, thus operating arm is FIG. 10A, FIG. 10B is pulled away from guitar body until adjustable tail piece FIG. 10C comes to rest upon stop block or plate FIG. 8C, returning to pitch and standard hard tail tension as per FIG. 30A, yet in order to raise tension and pitch, pull said operating arm FIG. 10A FIG. 10B across instrument strings, thus swinging adjustable tail piece FIG. 10C clear of said stop block or plate FIG. 8C thus allowing operating arm FIG. 10A, FIG. 10B to be pulled away from instrument body, which in turn enables adjustable tail piece FIG. 10C to lower beyond said stop block or plate FIG. 8C, wherein operation shaft FIG. 11A rotates towards said springs FIG. 21D thus pulling conrod FIG. 11J back towards said springs FIG. 21D, thus lowering tremolo tail stop folded steel sheet FIG. 9A, FIG. 9B, FIG. 9C FIG. 9E which in turn pulls instrument strings tight over instrument bridge thus raising pitch and string tension as per FIG. 30C, thus when operation is complete, said tremolo FIG. 2 is returned to position FIG. 30A, therefore operator can move fluidly through all positions to achieve desired effect, thus all tremolos operated in the same way, however mechanisms differ.

The advantages of the presented invention system are such that, the player can have one stringed instrument on stage instead of two, as long as instrument instrument is of tune o matic design you do not need to make any alterations or extra holes in the instrument body remains, but simply use the threaded inserts situated for tail piece anchorage, yet for any instrument that has strings anchored directly through the instrument body you will need to make screw holes in the instrument body to fit such variants as there is no tail piece, however for such through body strung instruments there is no tremolo available today that would allow said instrument to retain its through body strung status, thus also the presented invention does not rely upon string tension in in any way for operation and therefore has a greater flexibility of variation, since there is no reliance upon sliding plates, micro bearings, compression springs or locking devices as with other tremolos, thus all return to pitch is controlled by the operator through mechanical means that that are within the operators means to control without any external influences from said instrument, thus said instrument will always return to pitch since adjustable tail piece always returns to the same position upon presented invention stop block or plate FIG. 8C, thus the bolt on term refers to the retro fitting of said tremolo upon existing tail piece holes or direct fixing upon an unblemished instrument body, as such all previously stated is created by separating the string anchorage from the springs by a conrod, thus creating a differential force, which makes this tremolo effective and no other tremolo available today has.

What is claimed is:

1. A stringed musical instrument with a surface mounted tremolo device: said device comprising: a hinge, plurality of through going bores; said bores bolting off a plurality of shafts; a folded steel sheet; a plurality pivot pieces; said plurality of pivot pieces bolting off said tremolo device; a conrod: said shafts bolting off said through going bores; wherein said tremolo device being of a differential force transfer mechanism than said hinge with respect to receiving said conrod connection; said connection engaging said sheet to increase a turning force of said sheet.

* * * * *